US005990857A

United States Patent [19]

Kubota et al.

[11] Patent Number: 5,990,857

[45] Date of Patent: Nov. 23, 1999

[54] SHIFT REGISTER HAVING A PLURALITY OF CIRCUIT BLOCKS AND IMAGE DISPLAY APPARATUS USING THE SHIFT REGISTER

[75] Inventors: Yasushi Kubota, Sakurai; Kenichi Katoh, Higashihiroshima; Jun Koyama, Atsugi; Hidehiko Chimura, Atsugi; Yukio Tanaka, Atsugi, all of Japan

[73] Assignees: Sharp Kabushiki Kaisha, Osaka; Semiconductor Energy Laboratory Co., Ltd., Kanagawa-ken, both of Japan

[21] Appl. No.: 08/841,585

[22] Filed: Apr. 30, 1997

[30] Foreign Application Priority Data

May 23, 1996 [JP] Japan ..... 8-128830
Aug. 22, 1996 [JP] Japan ..... 8-221600

[51] Int. Cl.[6] ..... G09G 3/36

[52] U.S. Cl. ..... 345/98; 345/100; 345/204; 345/213

[58] Field of Search ..... 345/87, 94, 98, 345/99, 100, 204, 213

[56] References Cited

U.S. PATENT DOCUMENTS 5,103,218 4/1992 Takeda ..... 345/100
5,192,945 3/1993 Kusada ..... 345/100
5,434,599 7/1995 Hirai et al. ..... 345/100
5,589,847 12/1996 Lewis ..... 345/98
5,602,561 2/1997 Kawaguchi et al. ..... 345/99
5,617,111 4/1997 Saitoh ..... 345/100

FOREIGN PATENT DOCUMENTS 63-50717 10/1988 Japan .
63-271298 11/1988 Japan .
5-325584 12/1993 Japan .

*Primary Examiner*—Dennis-Doon Chow
*Assistant Examiner*—Amr Awad
*Attorney, Agent, or Firm*—Nixon & Vanderhye P.C.

[57] ABSTRACT

The shift register of this invention for sequentially transferring a digital signal in synchronization with a clock signal includes: a plurality of circuit blocks connected in series, each including a prescribed number of sequential latch circuits, each latch circuit outputting a signal corresponding to an input signal based on the clock signal; and a plurality of clock signal control circuits provided for the respective circuit blocks for controlling the supply of the clock signal to the latch circuits in the corresponding circuit blocks, wherein the control of the supply of the clock signal by each clock signal control circuit to the latch circuits in the corresponding circuit block is conducted in response to output signals from prescribed latch circuits in the circuit blocks preceding and subsequent to the corresponding circuit block.

31 Claims, 22 Drawing Sheets

PRIOR ART

PRIOR ART

PRIOR ART

PRIOR ART

SHIFT REGISTER HAVING A PLURALITY OF CIRCUIT BLOCKS AND IMAGE DISPLAY APPARATUS USING THE SHIFT REGISTER

BACKGROUND OF THE INVENTION

1. Field of the Invention

The present invention relates to a shift register and an image display apparatus using the same. More specifically, the present invention relates to a shift register where latch circuits constituting the shift register are divided into a plurality of circuit blocks and a clock signal is selectively supplied only to latch circuits in a circuit block which is currently transferring a digital signal, and an active matrix image display apparatus using such a shift register for its data signal line driver and the like.

2. Description of the Related Art

Shift registers have been widely used in various types of electronic apparatuses. Hereinbelow, a conventional shift register with a large number of stages which is used for a driver of an image display apparatus will be specifically described.

FIG. 18 schematically shows a conventional active matrix liquid crystal display apparatus. A liquid crystal display apparatus 200 includes a liquid crystal panel 31, a data signal line driver 32, and a scanning signal line driver 33. The liquid crystal panel 31 includes a pair of transparent substrates made of glass or the like disposed to face each other with liquid crystal interposed therebetween. On one of the transparent substrates, M data signal lines $SL_1$ to $SL_M$ run in one direction and N scanning signal lines $GL_1$ to $GL_N$ run in a direction perpendicular to the direction of the data signal lines $SL_1$ to $SL_M$. At the crossing of each data signal line $SL_i$ ($1 \leqq i \leqq M$; i is an integer) and each scanning signal line $GL_j$ ($1 \leqq j \leqq N$; j is an integer), a pixel $PIX_{i,j}$ is formed.

The data signal line driver 32 samples a data signal DAT based on a data clock signal CKS and a data start signal SPS, and distributes the sampled signal to the data signal lines $SL_1$ to $SL_M$. The scanning signal line driver 33 scans the scanning signal lines $GL_1$ to $GL_N$ one by one sequentially based on a scanning clock signal CKG and a scanning start signal SPG and selects a row of pixels $PIX_{1,j}$ to $PIX_{M,j}$ in which the data signal DAT supplied to the data signal lines $SL_1$ to $SL_M$ should be written.

Referring to FIG. 19, the data signal line driver 32 supplies the data signal DAT to the data signal line $SL_i$ by a point sequential driving method or a line sequential driving method. In the point sequential driving method, the data signal DAT is supplied to the data signal line $SL_i$ whenever it is sampled. In the line sequential driving method, the data signal DAT is sequentially sampled for one horizontal scanning period and held, and the sampled sequential data signal DAT corresponding to one line is supplied to the data signal lines $SL_1$ to $SL_M$ at one time. The data signal line driver 32 of either of the above driving methods uses a shift register. Hereinbelow, the data signal line driver of the point sequential driving method where the circuit configuration is simpler will be described.

Referring to FIG. 19, the data signal line driver 32 includes a shift register 34 composed of M latch circuits $LT_1$ to $LT_M$. The shift register 34 sequentially transfers the data start signal SPS through the latch circuits $LT_1$ to $LT_M$ in synchronization with the data clock signal CKS. The data start signal SPS is a pulse signal which includes a pulse every horizontal scanning period. The data start signal SPS is output from the latch circuits $LT_1$ to $LT_M$ as parallel latch signals to control terminals of corresponding sampling switches $ASW_1$ to $ASW_M$ via corresponding buffer circuits $BUF_1$ to $BUF_M$. Each buffer circuit $BUF_i$ amplifies, and if required inverts, the data start signal SPS held in the latch circuit $LT_i$. Each sampling switch $ASW_i$ is an analog switch which turns on/off the circuit depending on the input at the control terminal thereof. The data signal DAT is supplied to the data signal lines $SL_1$ to $SL_M$ through the sampling switches $ASW_1$ to $ASW_M$. Thus, in the data signal line driver 32, the pulse of the data start signal SPS is sequentially transferred through the latch circuits $LT_1$ to $LT_M$ of the shift register 34 every horizontal scanning period to sequentially turn on the corresponding sampling switches $ASW_1$ to $ASW_M$, so that the data signal DAT is sampled and supplied to the corresponding data signal lines $SL_1$ to $SL_M$.

The scanning signal line driver 33 can be realized by using a shift register or a combination of a counter and a decoder. A shift register is often used because the circuit configuration is simpler and the number of transistors required is smaller. Hereinbelow, the scanning signal line driver using a shift register will be described.

Referring to FIG. 20, the scanning signal line driver 33 includes a shift register 35 composed of N latch circuits $LT_1$ to $LT_N$. The shift register 35 sequentially transfers the scanning start signal SPG through the latch circuits $LT_1$ to $LT_N$ in synchronization with the scanning clock signal CKG. The scanning start signal SPG is a pulse signal which includes a pulse every vertical scanning period. The scanning start signal SPG is output from the latch circuits $LT_1$ to $LT_N$ as parallel latch signals to corresponding logic gates $LOG_1$ to $LOG_N$ via corresponding first buffer circuits $BUF_{1,1}$ to $BUF_{1,N}$. The logic gates $LOG_1$ to $LOG_N$ also receive a scanning control signal GPS for controlling the scanning. The outputs of the logic gates $LOG_1$ to $LOG_N$ are connected to the corresponding scanning signal lines $GL_1$ to $GL_N$ via corresponding second buffer circuits $BUF_{2,1}$ to $BUF_{2,N}$. Thus, in the scanning signal line driver 33, the pulse of the scanning start signal SPG is sequentially transferred through the latch circuits $LT_1$ to $LT_N$ of the shift register 35 every vertical scanning period to sequentially activate the corresponding scanning signal lines $GL_1$ to $GL_N$.

Referring to FIG. 21, the pixel $PIX_{i,j}$ formed at the crossing of the data signal line $SL_i$ and the scanning signal line $GL_j$ in the liquid crystal panel 31 includes a switching element SW and a pixel capacitance composed of a liquid crystal (LC) capacitor $C_l$ and a storage capacitor $C_s$. The switching element SW is a thin film transistor (TFT) of a MOSFET type formed on one of the transparent substrates. The gate of the switching element SW is connected with the scanning signal line $GL_j$. The LC capacitor $C_l$ is formed between a pixel electrode of the pixel $PIX_{i,j}$ formed on one of the transparent substrates and a common electrode formed on the other transparent substrate via the liquid crystal. The storage capacitor $C_s$ is formed as required to supplement charges stored in the LC capacitor $C_l$. One electrode of the storage capacitor $C_s$ is formed on one of the transparent substrates. The pixel electrode of the LC capacitor $C_l$ and this electrode of the storage capacitor $C_s$ are connected with the data signal line $SL_i$ via the source-drain of the switching element SW. With this configuration, when the scanning signal line $GL_j$ is made active by the scanning of the scanning signal line driver 33, the switching elements SW of the pixels $PIX_{1,j}$ to $PIX_{M,j}$ corresponding to the scanning signal line $GL_j$ are turned on, allowing the data signal DAT supplied to the data signal lines $SL_1$ to $SL_M$ from the data signal line driver 32 to be written in the LC capacitors $C_l$ and the storage capacitors $C_s$ of the pixels $PIX_{1,j}$ to $PIX_{M,j}$. Thus, the applied voltage at the LC capacitor $C_l$ of the pixel $PIX_{i,j}$ changes depending on the data signal DAT written in the LC capacitor $C_l$. This makes it possible to control the transmittance and reflectance of the liquid crystal at the pixel $PIX_{i,j}$. In this way, the liquid crystal display apparatus 200 (FIG. 18) can realize image display with N×M pixels.

The shift registers 34 and 35 used in the data signal line driver 32 and the scanning signal line driver 33 of the conventional liquid crystal display apparatus will be described more specifically.

Referring to FIG. 22, in the shift register 34 or 35, a start signal ST (the data start signal SPS or the scanning start signal SPG) is sequentially transferred through the latch circuits $LT_1$ to $LT_K$ (K stages in this example) based on not only a clock signal CLK (the data clock signal CKS or the scanning clock signal CKG) but also a clock signal CLK bar obtained by inverting the clock signal CLK, to obtain output signals $OUT_1$ to $OUT_K$.

FIG. 23 shows a specific example of two adjacent latch circuits $LT_k$ and $LT_{k+1}$ ($1 \leqq k \leqq K$; k is an odd number) of the shift register 34 or 35 (FIG. 22). The preceding latch circuit $LT_k$ includes one inverter 1 and two clocked inverters 2 and 3, while the subsequent latch circuit $LT_{k+1}$ includes one inverter 4 and two clocked inverters 5 and 6. Each of the clocked inverters 2, 3, 5, and 6 is a 3-state buffer which serves as a normal inverter when the input at the control terminal thereof is active but outputs high impedance when it is inactive. In the latch circuit $LT_k$ or $LT_{k+1}$, the inverter 1 or 4 and the clocked inverter 2 or 5 are connected to form a loop, constituting a flipflop circuit. The start signal ST is input into the other clocked inverter 3 or 6 and transferred to the next stage via the inverter 1 or 4. The output signal $OUT_k$ or $OUT_{k+1}$ is obtained from the output of the clocked inverter 3 or 6. The clock signal CLK is supplied to the control terminal of the clocked inverter 3 of the preceding latch circuit $LT_k$ and the control terminal of the clocked inverter 5 of the subsequent latch circuit $LT_{k+1}$. The inverted clock signal CLK bar is supplied to the control terminal of the clocked inverter 2 of the preceding latch circuit $LT_k$ and the control terminal of the clocked inverter 6 of the subsequent latch circuit $LT_{k+1}$.

In the latch circuits $LT_k$ and $LT_{k+1}$ with the above configuration, when the clock signal CLK becomes active, the preceding latch circuit $LT_k$ receives the start signal ST via the clocked inverter 3, while the subsequent latch circuit $LT_{k+1}$ shuts off the input to hold the start signal ST which had been input until immediately before the shutoff in the flipflop circuit composed of the inverter 4 and the clocked inverter 5. When the inverted clock signal CLK bar becomes active in the next half cycle, the preceding latch circuit $LT_k$ shuts off the input to hold the start signal ST which had been input until immediately before the shutoff in the flipflop circuit composed of the inverter 1 and the clocked inverter 2, while the subsequent latch circuit $LT_{k+1}$ receives the start signal ST output from the preceding latch circuit $LT_k$ via the clocked inverter 6. Thus, the latch circuits $LT_k$ and $LT_{k+1}$ sequentially latch the start signal ST received from the preceding latch circuit and transfer the latched signal to the subsequent latch circuit in response to the rising and falling of the clock signal CLK.

The shift register 34 or 35 transfers only one pulse every horizontal scanning period or every vertical scanning period. Accordingly, the power consumption required for the transfer of the start signal ST (power consumption with respect to a power terminal) is not so large. However, the clock signals CLK and CLK bar are input into the control terminals of the clocked inverters 2, 3, 5, and 6 of the latch circuits $LT_k$ and $LT_{k+1}$, changing the signal levels repeatedly within one horizontal scanning period and one vertical scanning period. Moreover, the number of stages (latch circuits) of the shift register 34 or 35 used in a display apparatus is very large as described above. For example, in the 640×480 dot VGA (video graphics array) standard, 640 stages are required for the data signal line driver 32 while 480 stages for the scanning signal line driver 33. In the 1024×768 dot XGA (extended graphics array) standard, 1024 stages are required for the data signal line driver 32 while 768 stages for the scanning signal line driver 33.

In the conventional shift register 34 or 35, therefore, a large amount of current flows to charge or discharge parasitic capacitances of signal lines for the clock signal CLK and gate capacitances of the clocked inverters 2, 3, 5, and 6. This undesirably increases the power consumption.

In the above-described conventional active matrix liquid crystal display apparatus, the switching element SW of the pixel $PIX_{i,j}$ is often a TFT made of amorphous silicon formed on one of the transparent substrates of the liquid crystal panel 31. In this case, the data signal line driver 32 and the scanning signal line driver 33 are provided as external integrated circuits (ICs). However, with the recent trend towards a larger screen size of the liquid crystal display apparatus, there is a need for cost reduction for the ICs of the data signal line driver 32 and the scanning signal line driver 33, improvement of the reliability at the mounting of such ICs, and the like. To meet these needs, a technique of integrally forming the drivers 32 and 33 on the transparent substrate of the liquid crystal panel 31 has been developed. According to this technique, TFTs including a polysilicon layer formed on a substrate made of a heat-resistant, transparent material such as silica glass are used as transistors for the drivers 32 and 33 as well as the switching element SW of the pixel $PIX_{i,j}$. Another approach has been studied where polysilicon TFTs are formed on a glass substrate at a process temperature below a glass distortion point (about 60° C.). FIG. 24 shows a configuration of a liquid crystal display apparatus employing this approach. A liquid crystal display apparatus 300 includes a data signal line driver 32*a* and a scanning signal line driver 33*a* monolithically formed on a transparent substrate of a liquid crystal display panel 31 together with pixels $PIX_{1,1}$ to $PIX_{M,N}$, data signal lines $SL_1$ to $SL_M$, and scanning signal lines $GL_1$ to $GL_N$. Only a timing signal generation circuit 36 and a power voltage generation circuit 37 are provided externally. When polysilicon TFTs are used as in this case, the above-described point sequential driving method where the circuit configuration is simpler is often employed for the data signal line driving circuit 32*a*.

However, polysilicon TFTs have inferior device characteristics compared with single crystalline silicon transistors of normal ICs formed on a single crystalline silicon substrate. A large device size is therefore required, and this increases the gate capacitances. Accordingly, if the conventional shift registers 34 and 35 (FIG. 22) are used for the data signal line driver 32*a* and the scanning signal line driver 33*a*, the gate capacitances of the clocked inverters 2, 3, 5, and 6 increase. This undesirably results in further increasing the power consumption.

In order to overcome the above problem, Japanese Patent Publication No. 63-50717 and Japanese Laid-Open Patent Publication No. 63-271298 disclose techniques where a shift register is divided into a plurality of circuit blocks to supply a clock signal only to a circuit block which is currently transferring a pulse of a start signal to suppress the increase in the power consumption caused by the clock signal.

More specifically, according to th e technique disclosed in the Japanese Patent Publication No. 63-50717, a start signal is transferred through a shift register for selection having stages corresponding to the number of circuit blocks obtained by dividing an original shift register in synchronization with a clock signal processed by a frequency divider, so that only a circuit block requiring the clock signal can be sequentially selected. This publication also discloses a technique where the circuit block is selected by a counter for counting the clock signal and a decoder for decoding the output of the counter. However, these techniques additionally require the frequency divider and the shift register for selection or the counter and the decoder for selecting the circuit block, causing another problem of increasing the circuit size and complexity.

According to the technique disclosed in the Japanese Laid-Open Patent Publication No. 63-271298, the timing when a clock signal is supplied to each circuit block obtained by dividing a shift register is determined based on the transferred signal output from the preceding circuit block, while the timing when the supply of the clock signal is terminated is determined based on the transferred signal output from itself. However, this technique additionally requires circuits for determining the timings when the supply of the clock signal is initiated and terminated, causing another problem of increasing the circuit size.

SUMMARY OF THE INVENTION

The shift register of this invention for sequentially transferring a digital signal in synchronization with a clock signal includes: a plurality of circuit blocks connected in series, each including a prescribed number of sequential latch circuits, each latch circuit outputting a signal corresponding to an input signal based on the clock signal; and a plurality of clock signal control circuits provided for the respective circuit blocks for controlling the supply of the clock signal to the latch circuits in the corresponding circuit blocks, wherein the control of the supply of the clock signal by each clock signal control circuit to the latch circuits in the corresponding circuit block is conducted in response to output signals from prescribed latch circuits in the circuit blocks preceding and subsequent to the corresponding circuit block.

In one embodiment of the invention, each clock signal control circuit initiates the supply of the clock signal to the latch circuits in the corresponding circuit block in response to an output signal from one of the latch circuits in the preceding circuit block, and terminates the supply of the clock signal to the latch circuits in the corresponding circuit block in response to an output signal from one of the latch circuits downstream of the first latch circuit in the subsequent circuit block.

In another embodiment of the invention, a transistor constituting the latch circuit is a thin film transistor including a polysilicon layer.

According to another aspect of the invention, an active matrix image display apparatus using the above shift register is provided. The apparatus includes: a liquid crystal panel including a plurality of pixels arranged in columns and rows, a plurality of data signal lines disposed for the columns of the pixels, and a plurality of scanning signal lines disposed for the rows of the pixels, image data for image display being supplied from the data signal lines to the pixels in synchronization with a scanning signal supplied from the scanning signal lines; a data signal line driver for sequentially outputting the image data to the plurality of data signal lines in synchronization with a prescribed timing signal; and a scanning signal line driver for sequentially outputting the scanning signal to the plurality of scanning signal lines in synchronization with a prescribed timing signal, wherein the data signal line driver includes the shift register as a circuit for sequentially shifting a sampling signal for receiving the image data in correspondence with the data signal lines.

Alternatively, the active matrix image display apparatus of this invention using the above shift register includes: a liquid crystal panel including a plurality of pixels arranged in columns and rows, a plurality of data signal lines disposed for the columns of the pixels, and a plurality of scanning signal lines disposed for the rows of the pixels, image data for image display being supplied from the data signal lines to the pixels in synchronization with a scanning signal supplied from the scanning signal lines; a data signal line driver for sequentially outputting the image data to the plurality of data signal lines in synchronization with a prescribed timing signal; and a scanning signal line driver for sequentially outputting the scanning signal to the plurality of scanning signal lines in synchronization with a prescribed timing signal, wherein the scanning signal line driver includes the shift register as a circuit for sequentially shifting the scanning signal in correspondence with the scanning signal lines.

In one embodiment of the invention, at least one of the data signal line driver and the scanning signal line driver includes elements formed on a substrate constituting the liquid crystal panel as circuit elements constituting the driver, together with elements constituting the pixels.

In another embodiment of the invention, the outputs of the latch circuits are inactivated by an initialization signal input externally.

In still another embodiment of the invention, each of the latch circuits includes one synchronous NAND circuit or synchronous NOR circuit, and the initialization signal is input into the synchronous NAND circuit or synchronous NOR circuit.

In still another embodiment of the invention, each of the clock signal control circuits includes a logic circuit which supplies the clock signal to the latch circuits in the corresponding circuit block in response to the input of an external initialization signal irrespective of the output signals from the latch circuits in the circuit blocks preceding and subsequent to the corresponding circuit block as the control signal.

Alternatively, the active matrix image display apparatus of this invention using the above shift register includes: a liquid crystal panel including a plurality of pixels arranged in columns and rows, a plurality of data signal lines disposed for the columns of the pixels, and a plurality of scanning signal lines disposed for the rows of the pixels, image data for image display being supplied from the data signal lines to the pixels in synchronization with a scanning signal supplied from the scanning signal lines; a data signal line driver for sequentially outputting the image data to the plurality of data signal lines in synchronization with a prescribed timing signal; and a scanning signal line driver for sequentially outputting the scanning signal to the plurality of scanning signal lines in synchronization with a prescribed timing signal, wherein the data signal line driver includes the shift register as a circuit for sequentially shifting a sampling signal for receiving the image data in correspondence with the data signal lines, and the initialization signal is input into the shift register when the image display apparatus is turned on.

Alternatively, the active matrix image display apparatus of this invention using the above shift register includes: a liquid crystal panel including a plurality of pixels arranged in columns and rows, a plurality of data signal lines disposed for the columns of the pixels, and a plurality of scanning signal lines disposed for the rows of the pixels, image data for image display being supplied from the data signal lines to the pixels in synchronization with a scanning signal supplied from the scanning signal lines; a data signal line driver for sequentially outputting the image data to the plurality of data signal lines in synchronization with a prescribed timing signal; and a scanning signal line driver for sequentially outputting the scanning signal to the plurality of scanning signal lines in synchronization with a prescribed timing signal, wherein the scanning signal line driver includes the shift register as a circuit for sequentially shifting the scanning signal in correspondence with the scanning signal lines, and the initialization signal is input into the shift register when the image display apparatus is turned on.

Alternatively, the active matrix image display apparatus of this invention using the above shift register includes: a liquid crystal panel including a plurality of pixels arranged in columns and rows, a plurality of data signal lines disposed for the columns of the pixels, and a plurality of scanning signal lines disposed for the rows of the pixels, image data for image display being supplied from the data signal lines to the pixels in synchronization with a scanning signal supplied from the scanning signal lines; a data signal line driver for sequentially outputting the image data to the plurality of data signal lines in synchronization with a prescribed timing signal; and a scanning signal line driver for sequentially outputting the scanning signal to the plurality of scanning signal lines in synchronization with a prescribed timing signal, wherein the data signal line driver includes the shift register as a circuit for sequentially shifting a sampling signal for receiving the image data in correspondence with the data signal lines, and the initialization signal is input into the shift register every vertical scanning retrace interval.

Alternatively, the active matrix image display apparatus of this invention using the above shift register includes: a liquid crystal panel including a plurality of pixels arranged in columns and rows, a plurality of data signal lines disposed for the columns of the pixels, and a plurality of scanning signal lines disposed for the rows of the pixels, image data for image display being supplied from the data signal lines to the pixels in synchronization with a scanning signal supplied from the scanning signal lines; a data signal line driver for sequentially outputting the image data to the plurality of data signal lines in synchronization with a prescribed timing signal; and a scanning signal line driver for sequentially outputting the scanning signal to the plurality of scanning signal lines in synchronization with a prescribed timing signal, wherein the scanning signal line driver includes the shift register as a circuit for sequentially shifting the scanning signal in correspondence with the scanning signal lines, and the initialization signal is input into the shift register every vertical scanning retrace interval.

In one embodiment of the invention, a scanning start signal for the scanning signal line driver is used as the initialization signal.

Thus, according to the present invention, a plurality of latch circuits connected in series constituting a shift register are divided into a plurality of circuit blocks each including a prescribed number of latch circuits. A clock signal control circuit is provided for each of the circuit blocks for controlling the supply of a clock signal to the latch circuits in the corresponding circuit block. This makes it possible to selectively supply the clock signal to the latch circuits, reducing the number of latch circuits to which the clock signal is simultaneously supplied. As a result, th e power consumption required for driving parasitic capacitances of clock signal lines in the circuit blocks, i.e., input gate capacitances and wiring capacitances of the latch circuits, can be greatly reduced.

Each of the clock signal control circuit controls the supply of the clock signal based on outputs from the latch circuits in the circuit blocks preceding and subsequent to the corresponding circuit block. This eliminates the necessity of providing a circuit for selecting the circuit blocks. Since the signal for selecting the circuit blocks is generated inside the shift register, an external terminal for receiving an external selection signal is not required.

The clock signal control circuit corresponding to the first circuit block which does not have a preceding circuit block may initiate the supply of the clock signal based on a change of an input pulse signal to the shift register to a prescribed signal level. Alternatively, it may initiate the supply of the clock signal based on any other initialization operation. The clock signal control circuit corresponding to the last circuit block which does not have a subsequent circuit block may terminate the supply of the clock signal based on an output signal from a dummy latch circuit in an additional circuit block provided subsequent to the last circuit block. Alternatively, it may terminate the supply of the clock signal based on the input pulse signal to the shift register.

In another embodiment of the present invention, each of the clock signal control circuits of the shift register terminates the supply of the clock signal based on an output signal from the second latch circuit or any latch circuit downstream of the second latch circuit in the subsequent circuit block. This ensures the transfer operation for at least one cycle of the clock signal after a change of the output signal from the last latch circuit in the corresponding circuit block to a prescribed level, allowing the output signal from the last latch circuit to return to the original level. The timing when the supply of the clock signal to each circuit block is initiated should be determined so that at least the transfer operation in the current circuit block can be initiated immediately after the output signal from the last latch circuit in the preceding circuit block changes to a prescribed level. Accordingly, the supply of the clock signal may be initiated based on the output signal from any latch circuit in the preceding circuit block as long as no signal delay occurs in the clock signal control circuit.

In still another embodiment of the present invention, the latch circuits in the circuit blocks of the shift register are formed of polysilicon TFTs which have larger gate capacitances and have inferior device characteristics compared with single crystalline silicon transistors. This increases the power consumption in the latch circuits. The effect of the present invention of reducing the power consumption by dividing the shift register into a plurality of circuit blocks to selectively drive each circuit block is therefore especially significant.

In still another embodiment of the present invention, the shift register for the data signal line driver of the active matrix image display apparatus is divided into a plurality of circuit blocks to selectively drive each circuit block. This reduces the power consumption required for the data signal line driver, and thus an active matrix image display apparatus with reduced power consumption can be realized.

In still another embodiment of the present invention, the shift register for the scanning signal line driver of the active matrix image display apparatus is divided into a plurality of circuit blocks to selectively drive each circuit block. This reduces the power consumption required for the scanning signal line driver, and thus an active matrix image display apparatus with reduced power consumption can be realized.

In still another embodiment of the present invention, circuit elements constituting at least one of the data signal line driver and the scanning signal line driver are formed on a substrate of a liquid crystal panel together with the pixels. This allows the pixels and the driver to be formed on the same substrate in the same process, reducing the cost required for mounting the drivers as well as improving the reliability at the mounting.

In still another embodiment of the present invention, the outputs of the latch circuits of the shift register are inactivated by an initialization signal supplied externally. This allows the internal nodes of the latch circuits, which may be in an indefinite state, to be inactivated compulsively when the apparatus is turned on. As a result, troubles associated with the clock signal control circuit being reset due to the output of a specific latch circuit in the subsequent circuit block when the apparatus is turned on can be prevented, and thus malfunctions due to this resetting of the clock signal control circuit, i.e., failure in the transfer operation of the shift register, can be prevented.

In still another embodiment of the present invention, the latch circuit includes one synchronous NAND circuit or synchronous NOR circuit, and the initialization signal is input into the synchronous NAND circuit or synchronous NOR circuit. This allows the output and the internal node of the latch circuit to be kept inactive compulsively during the period when the initialization signal is being input. As a result, malfunctions due to the resetting of the clock signal control circuit when the apparatus is turned on, i.e., failure in the transfer operation of the shift register, can be prevented.

In still another embodiment of the present invention, the clock signal control circuit includes a logic circuit which supplies the clock signal to the latch circuits in the corresponding circuit block in response to the input of the initialization signal irrespective of the control signal. Accordingly, the clock signal control circuit is kept active compulsively during the period when the initialization signal is being input to allow the clock signal to be supplied to the latch circuits. As a result, the shift register having a plurality of latch circuits can conduct normal shift operations, initializing the internal nodes of the latch circuits.

In still another embodiment of the present invention, since the initialization signal is input into the shift register when the apparatus is turned on, malfunctions of the shift register when the apparatus is turned on can be prevented.

In still another embodiment of the present invention, the initialization signal is input into the shift register at every vertical scanning retrace interval. This eliminates the necessity of providing a means for detecting the activation (i.e., power-on) of the apparatus which is required for the configuration where the initialization signal is input into the shift register when the apparatus is turned on. This simplifies the configuration and prevents malfunctions of the shift register when the apparatus is turned on.

In still another embodiment of the present invention, the scanning start signal for the scanning signal line driver is used as the initialization signal. This eliminates the necessity of providing not only a means for detecting the activation (i.e., power-on) of the apparatus which is required for the configuration where the initialization signal is input into the shift register when the apparatus is turned on, but also a new synchronization signal as the initialization signal. This simplifies the configuration and prevents malfunctions of the shift register when the apparatus is turned on.

Thus, the invention described herein makes possible the advantages of (1) providing a shift register which can suppress the increase of power consumption by controlling a clock signal to be supplied to circuit blocks and prevent the circuit size from unduly increasing due to the control of the clock signal, and (2) providing an image display apparatus using such a shift register.

These and other advantages of the present invention will become apparent to those skilled in the art upon reading and understanding the subsequent detailed description with reference to the accompanying figures.

DESCRIPTION OF THE PREFERRED EMBODIMENTS

The present invention will be described by way of examples with reference to the accompanying drawings.

EXAMPLE 1

Figure 1:
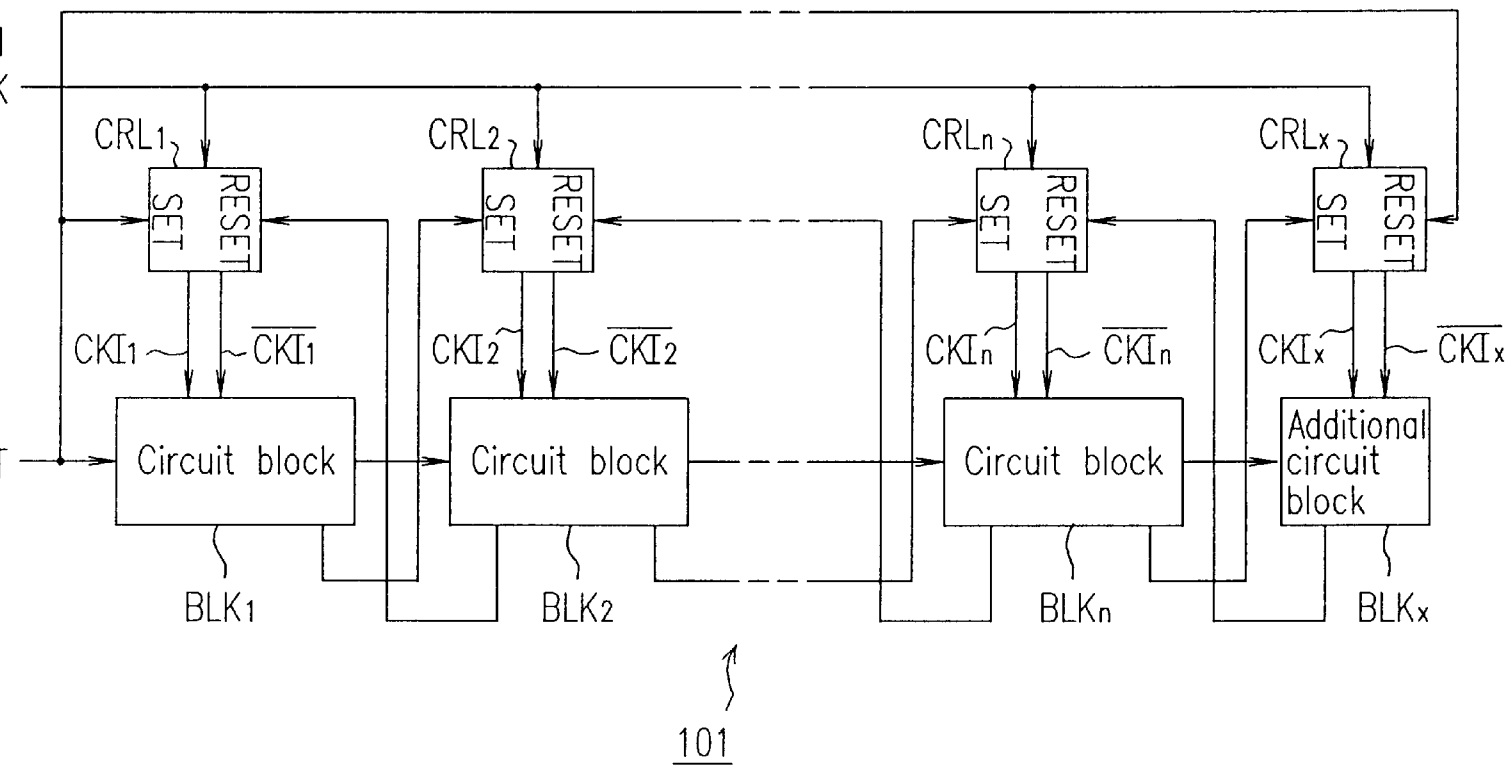
FIG. 1 is a block diagram schematically showing a shift register of Example 1 according to the present invention.
Figure 2:
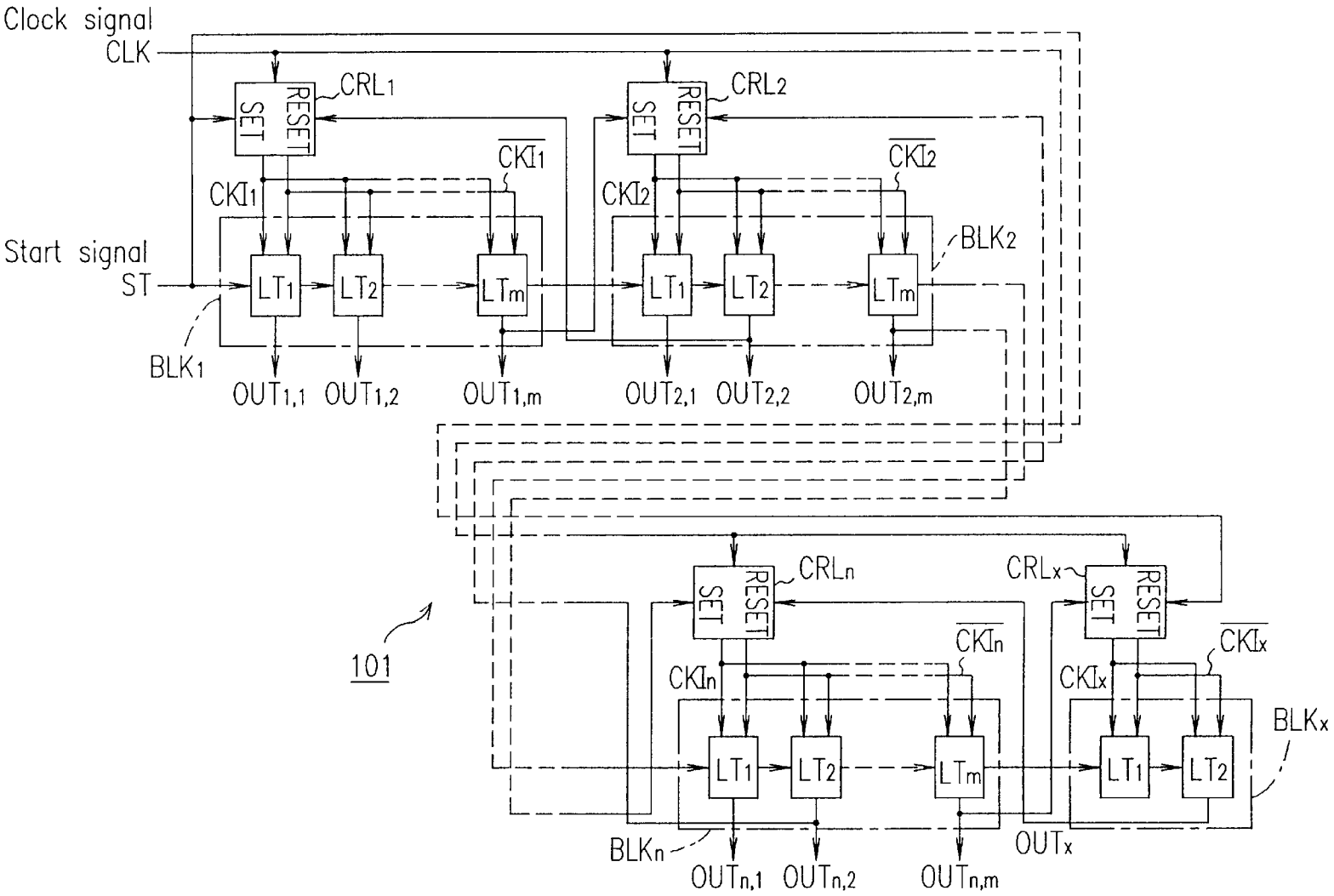
FIG. 2 is a block diagram showing the shift register of Example 1 in more detail.

FIG. 1 is a block diagram of a shift register of Example 1 according to the present invention. FIG. 2 is a block diagram showing the shift register in more detail.

In this example, a 1-bit shift register is divided into n circuit blocks each including m latch circuits. The number of circuit blocks in the shift register and the number of latch circuits in each circuit block are not specified. The number of latch circuits in one circuit block may be different from that in another circuit block. The present invention is also applicable to a multi-bit shift register.

Referring to FIG. 1, a shift register 101 includes n circuit blocks (of latch circuits) $BLK_1$ to $BLK_n$, one additional circuit block (of latch circuits) $BLK_x$, clock signal control circuits $CRL_1$ to $CRL_n$ corresponding to the circuit blocks $BLK_1$ to $BLK_n$, and an additional clock signal control circuit $CRL_x$ corresponding to the additional circuit block $BLK_x$.

The n circuit blocks $BLK_1$ to $BLK_n$ are connected in series, and a start signal ST is supplied to the input of the first circuit block $BLK_1$. The additional circuit block $BLK_x$ is a small group of latch circuits connected to the output of the last circuit block $BLK_n$. In the case where the start signal ST is utilized by a subsequent circuit after being transferred in series through the shift register of this example, the subsequent circuit should be connected to the output of the last circuit block $BLK_n$.

A clock signal CLK for the shift register is input into the clock signal control circuits $CRL_1$ to $CRL_n$ and the additional clock signal control circuit $CRL_x$, and converted into internal clock signals $CKI_1$ to $CKI_n$ and $CKI_x$ and internal clock signals $CKI_1$ bar to $CKI_n$ bar and $CKI_x$ bar obtained by inverting these signals, to be supplied to the corresponding circuit blocks $BLK_1$ to $BLK_n$ and additional circuit block $BLK_x$. Each of the clock signal control circuits $CRL_1$ to $CRL_n$ and the additional clock signal control circuit $CRL_x$ has a set terminal SET and a reset terminal RESET. The set terminal SET of each of the clock signal control circuits $CRL_2$ to $CRL_n$ and the additional clock signal control circuit $CRL_x$ receives one of the parallel outputs from one of the circuit blocks $BLK_1$ to $BLK_n$ preceding the corresponding circuit block. The reset terminal RESET of each of the clock signal control circuits $CRL_1$ to $CRL_n$ receives one of parallel outputs from the one of the circuit blocks $BLK_2$ to $BLK_n$ and the additional circuit block $BLK_x$ subsequent to the corresponding circuit block. The set terminal SET of the first clock signal control circuit $CRL_1$ and the reset terminal RESET of the additional clock signal control circuit $CRL_x$ receive the start signal ST.

Referring to FIG. 2, each of the circuit blocks $BLK_1$ to $BLK_n$ includes m latch circuits $LT_1$ to $LT_m$ connected in series. The internal clock signals $CKI_1$ to $CKI_n$ and the inverted internal clock signals $CKI_1$ bar to $CKI_n$ bar are supplied from the clock signal control circuits $CRL_1$ to $CRL_n$ to the latch circuits $LT_1$ to $LT_m$ in the corresponding circuit blocks $BLK_1$ to $BLK_n$. The outputs of the latch circuits $LT_1$ to $LT_m$ of the first circuit block $BLK_1$ are externally supplied as output signals $OUT_{1,1}$ to $OUT_{1,m}$. This also applies to the latch circuits $LT_1$ to $LT_m$ of the other circuit blocks $BLK_2$ to $BLK_n$. Thus, nxm-bit output signals $OUT_{1,1}$ to $OUT_{n,m}$ are externally supplied as parallel outputs of the shift register. The additional circuit block $BLK_x$ includes only two latch circuits $LT_1$ and $LT_2$ connected in series, which receive the internal clock signal $CKI_x$ and the inverted internal clock signal $CKI_x$ bar supplied from the additional clock signal control circuit $CRL_x$.

In FIG. 2, the set terminal SET of each of the clock signal control circuits $CRL_2$ to $CRL_n$ and the additional clock signal control circuit $CRL_x$ receives the output signal $OUT_{i,m}$ ($1 \leqq i \leqq n$; i is an integer) from the last latch circuit $LT_m$ of the preceding one of the circuit blocks $BLK_1$ to $BLK_n$. The set terminal SET may also receive any one of the output signals $OUT_{i,1}$ to $OUT_{i,m-1}$ from the latch circuits $LT_1$ to $LT_{m-1}$ of the preceding circuit block.

The reset terminal RESET of each of the clock signal control circuits $CRL_1$ to $CRL_n$ receives the output signal $OUT_{i,2}$ from the second latch circuit $LT_2$ of the subsequent corresponding circuit blocks $BLK_2$ to $BLK_n$ or the output signal $OUT_x$ from the latch circuit $LT_2$ of the additional circuit block $BLK_x$. The reset terminal RESET may also receive any one of the output signals $OUT_{i,3}$ to $OUT_{i,m}$ from the latch circuits $LT_3$ to $LT_m$ of the subsequent circuit block. In this case, however, the number of latch circuits in the additional circuit block $BLK_x$ should be increased to three or more.

Figure 3:
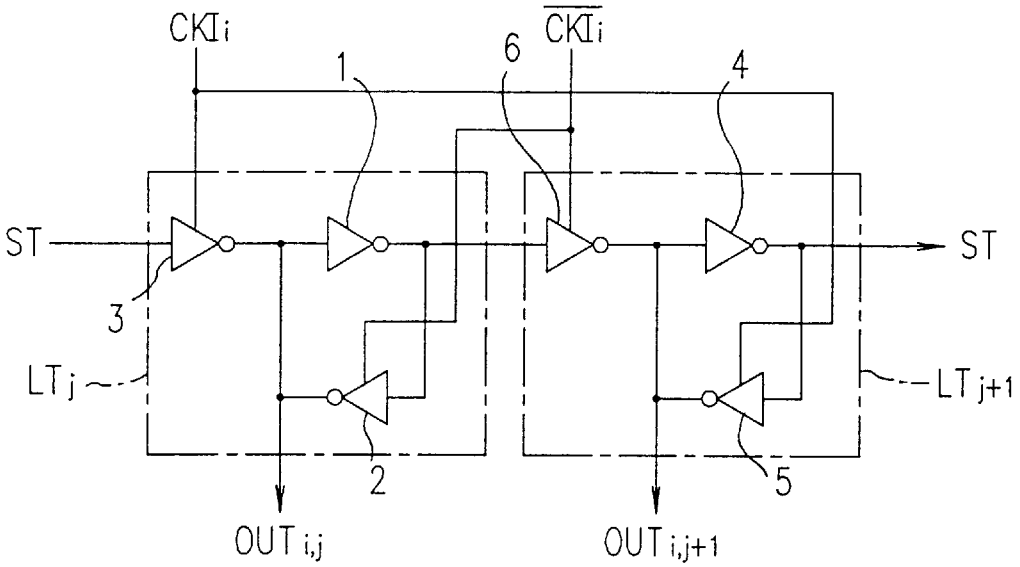
FIG. 3 is a block diagram of two adjacent latch circuits of the shift register of Example 1.
Figure 23:
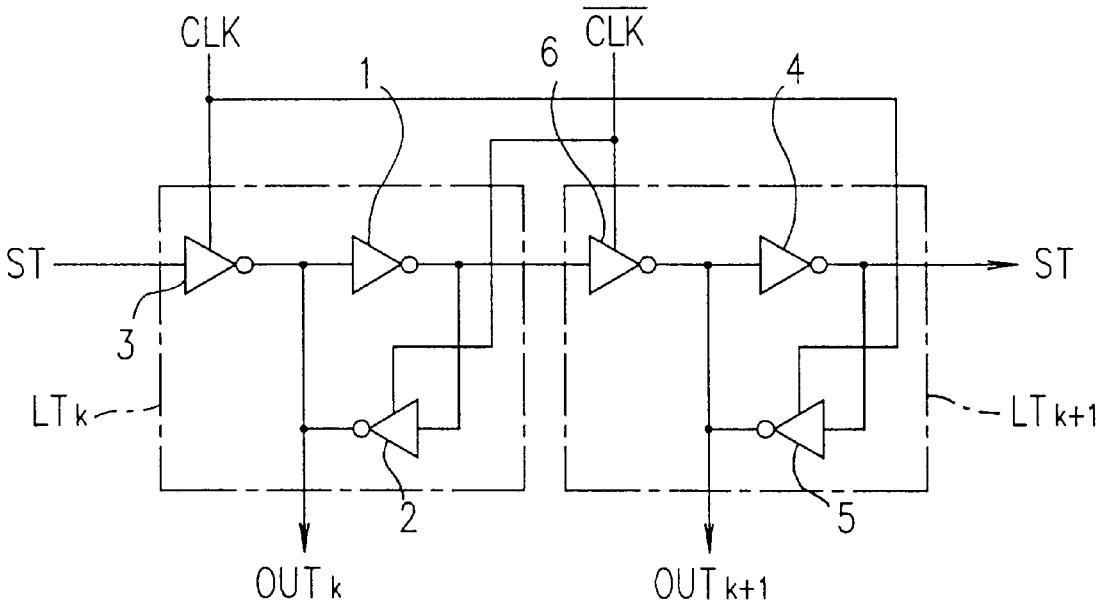
FIG. 23 is a block diagram of two adjacent latch circuits of the conventional shift register.
Figure 24:
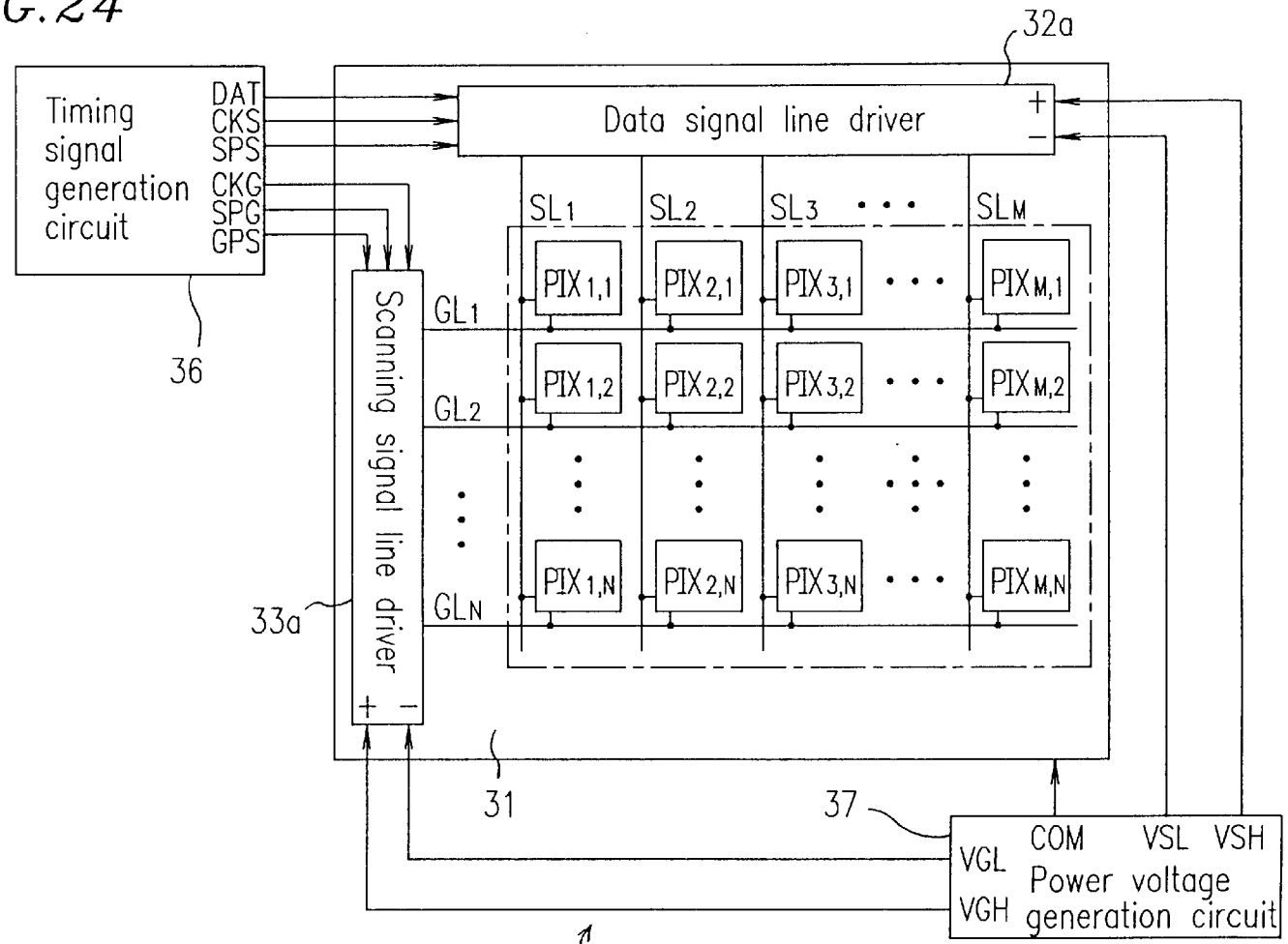
FIG. 24 PRIOR ART
FIG. 24 is a block diagram schematically showing another conventional active matrix image display apparatus.

FIG. 3 shows a specific configuration of two adjacent latch circuits $LT_j$ and $LT_{j+1}$ ($1 \leqq j \leqq m$; j is an odd number). The configuration of these latch circuits $LT_j$ and $LT_{j+1}$ is the same as that of the latch circuits $LT_k$ and $LT_{k+1}$ ($1 \leqq k \leqq K$; k is an odd number) shown in FIG. 23, except that the internal clock signals $CKI_i$ and $CKI_i$ bar are input into the control terminals of clocked inverters 2, 3, 5, and 6, instead of the clock signals CLK and CLK bar. Output signals $OUT_{i,j}$ and $OUT_{i,j+1}$ are obtained from the outputs of the clocked inverters 3 and 6 of the latch circuits $LT_j$ and $LT_{j+1}$, respectively. The output signals $OUT_{i,j}$ and $OUT_{i,j+1}$ may also be obtained from the outputs of inverters 1 and 4. The configuration of the latch circuits $LT_1$ and $LT_2$ in the additional circuit block $BLK_x$ is the same as that described above. Specifically, the internal clock signals $CKI_x$ and $CKI_x$ bar from the additional clock signal control circuit $CRL_x$ are input into the control terminals of the clocked inverters 2, 3, 5, and 6.

Thus, the latch circuits $LT_j$ and $LT_{j+1}$ with the above configuration sequentially latch the start signal ST received from the preceding latch circuit and transfer the latched signal to the subsequent latch circuit in response to the rising and falling of the internal clock signal $CKI_i$.

Figure 4:
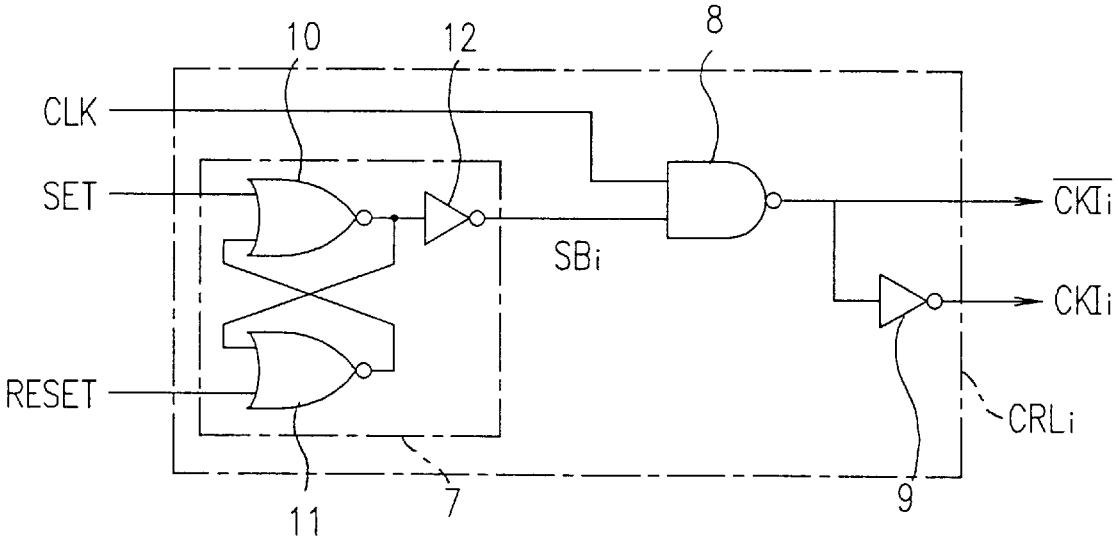
FIG. 4 is a block diagram of a clock signal control circuit of the shift register of Example 1.

FIG. 4 shows a configuration of each clock signal control circuit $CRL_i$ of the shift register of this example. The clock signal control circuit $CRL_i$ includes a flipflop circuit 7, a NAND gate 8, and an inverter 9. The flipflop circuit 7 includes an RS flipflop circuit obtained by interconnecting an input of each of two NOR gates 10 and 11 with the output of the other NOR gate 10 or 11. The other input of the NOR gate 10 is connected with the set terminal SET, while the other input of the NOR gate 11 is connected with the reset terminal RESET. A block selection signal $SB_i$ is obtained from the output of the NOR gate 10 via an inverter 12. With this configuration, once the input at the set terminal SET becomes active, the block selection signal $SB_i$ becomes active. The active state of the block selection signal $SB_i$ is maintained even after the input at the set terminal SET returns to an inactive state. Once the input at the reset terminal RESET becomes active, the block selection signal $SB_i$ becomes inactive. The inactive state of the block selection signal $SB_i$ is maintained even after the input at the reset terminal RESET returns to an inactive state.

The block selection signal SBi is input into the NAND gate 8 together with the clock signal CLK. The NAND gate 8 outputs the internal clock signal $CKI_i$ via the inverter 9 and the inverted internal clock signal $CKI_i$ bar. Thus, the clock signal control circuit $CRL_i$ supplies the clock signal CLK as the internal clock signal $CKI_i$ and the inverted internal clock signal $CKI_i$ bar only during the period from the time when the input at the set terminal SET becomes active until the time when the input at the reset terminal RESET becomes active. During the other period, the internal clock signals $CKI_i$ and $CKI_i$ bar are kept at different fixed signal levels. Keeping the internal clock signals $CKI_i$ and $CKI_i$ bar at fixed signal levels prevents potential levels at internal nodes from varying due to noise and the like causing malfunction of the circuit block $BLK_i$. The additional clock signal control circuit $CRL_x$ has the same configuration as the clock signal control circuit $CRL_i$ described above.

The operation of the shift register with the above configuration will now be described.

Figure 5:
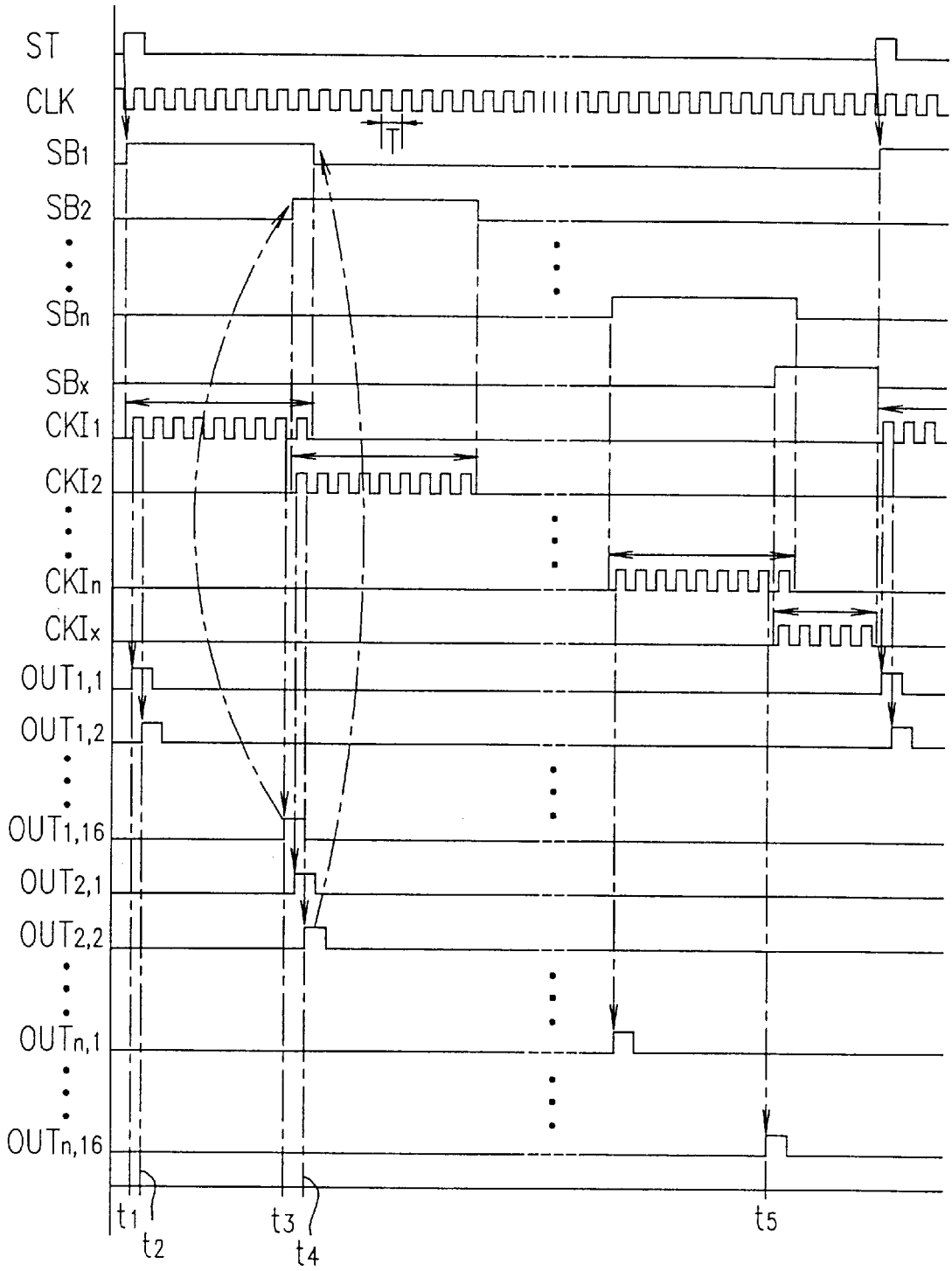
FIG. 5 is a waveform chart for describing the operation of the shift register of Example 1.

FIG. 5 is a timing chart for describing the operation of the shift register of this example. In the following description, it is assumed that: the circuit block $BLK_i$ is composed of 16 latch circuits (m=16); the clock signal CLK includes continuous pulses with a duty ratio of 1:1; and the start signal ST has a cycle slightly longer than 8n (=n·m/2) cycles of the clock signal CLK and rises to a high level for a period corresponding to one cycle of the clock signal CLK (hereinbelow, this period is referred to as a period T). This timing chart shows only the internal clock signals $CKI_1$ to $CKI_n$ and $CKI_x$, omitting the inverted internal clock signals $CKI_1$ bar to $CKI_n$ bar and $CKI_x$ bar for simplification.

When the start signal ST rises high, the set terminal SET of the clock signal control circuit $CRL_1$ becomes high (active) and slightly later the block selection signal $SB_1$ becomes high (active). This initiates the supply of the clock signal CLK to the circuit block $BLK_1$ as the internal clock signal $CKI_1$. When the internal clock signal $CKI_1$ initially rises at time $t_1$, the output signal $OUT_{1,1}$ from the first latch circuit $LT_1$ of the circuit block $BLK_1$ becomes high (active). When the internal clock signal $CKI_1$ falls at time $t_2$, the output signal $OUT_{1,2}$ from the second latch circuit $LT_2$ in the circuit block $BLK_1$ becomes high. The output signals $OUT_{1,1}$ and $OUT_{1,2}$ respectively fall to the low level after the lapse of the period T. In this manner, the output signals $OUT_{1,3}$ to $OUT_{1,16}$ sequentially become high for the period T whenever the internal clock signal $CKI_1$ rises and falls.

When the output signal $OUT_{1,16}$ becomes high at time $t_3$, the set terminal SET of the clock signal control circuit $CRL_2$ becomes high, and slightly later the block selection signal $SB_2$ becomes high. This initiates the supply of the clock signal CLK to the circuit block $BLK_2$ as the internal clock signal $CKI_2$. When the internal clock signal $CKI_2$ initially rises, the output signal $OUT_{2,1}$ from the first latch circuit $LT_1$ in the circuit block $BLK_2$ becomes high. When the internal clock signal $CKI_{2,2}$ falls at time $t_4$, the output signal $OUT_{2,2}$ from the second latch circuit $LT_2$ in the circuit block $BLK_2$ becomes high. The reset terminal RESET of the clock signal control circuit $CRL_1$ then becomes high, and slightly later the block selection signal $SB_1$ returns to the low level. This turns the internal clock signal $CKI_1$ to a fixed low level, terminating the supply of the clock signal CLK to the circuit block $BLK_1$. It should be noted that after the time $t_3$ one more pulse of the internal clock signal $CKI_1$ is supplied to the circuit block $BLK_1$. Thus, the output signal $OUT_{1,16}$ from the last latch circuit $LT_{16}$ in the circuit block $BLK_1$ normally returns to the low level at the time $t_4$ after the lapse of the period T from the time $t_3$. In this way, the circuit block $BLK_1$ initiates the transfer operation substantially simultaneously with the receipt of the pulse of the start signal ST with which the block selection signal $SB_1$ becomes high, and terminates the transfer operation substantially simultaneously with the completion of the transfer of this pulse.

The above operation is repeated to sequentially supply the clock signal CLK to the circuit blocks $BLK_2$ to $BLK_n$ as the internal clock signals $CKI_n$ to $CKI_n$. When the output signal $OUT_{n,16}$ from the last latch circuit $LT_{16}$ in the last circuit block $BLK_n$ becomes high at time $t_5$, the set terminal SET of the additional clock signal control circuit $CRL_x$ becomes high, and slightly later the block selection signal $SB_x$ becomes high. This initiates the supply of the clock signal CLK to the additional circuit block $BLK_x$ as the internal clock signal $CKI_x$. When the output signal $OUT_x$ (not shown in FIG. 5) from the second latch circuit $LT_2$ in the additional circuit block $BLK_x$ becomes high, the reset terminal RESET of the clock signal control circuit $CRL_n$ becomes high, and slightly later the block selection signal $SB_n$ returns to the low level. This turns the internal clock signal $CKI_n$ to a fixed low level, terminating the supply of the clock signal CLK to the last circuit block $BLK_n$.

Since one more pulse of the internal clock signal $CKI_n$ is supplied to the circuit block $BLK_n$ after the time $t_5$, the output signal $OUT_{n,16}$ from the last latch circuit $LT_{16}$ in the circuit block $BLK_n$ normally returns to the low level after the lapse of the period T from the time $t_5$. The additional circuit block $BLK_x$ is provided to completely terminate the transfer operation of the last circuit block $BLK_n$. After the internal clock signal $CKI_x$ repeats rising and falling several times, the start signal ST rises to the high level again. Then, the reset terminal RESET of the additional clock signal control circuit $CRL_x$ becomes high, and slightly later the block selection signal $SB_x$ returns to the low level. This turns the internal clock signal $CKI_x$ to a fixed low level, terminating the supply of the clock signal CLK to the additional circuit block $BLK_x$. The above operation is repeated in this way.

As described above, according to the shift register of this example, the clock signal CLK is supplied only to the circuit block $BLK_i$ where the high-level pulse portion of the start signal ST is currently being transferred. In other words, the clock signal CLK is supplied only to the latch circuits $LT_1$ to $LT_m$ corresponding to about 1/n of the entire shift register. Accordingly, the power consumption required for parasitic capacitances of signal lines, gate capacitances of the clocked inverters 2, 3, 5, and 6, and the like can be greatly reduced.

The timings when the supply of the clock signal CLK to each circuit block is initiated and terminated are obtained from the outputs of the latch circuits $LT_m$ and $LT_2$ in the preceding and subsequent corresponding circuit blocks $BLK_1$ to $BLK_n$ and the additional circuit block $BLK_x$. Accordingly, the supply of the clock signal CLK can be controlled only by the clock signal control circuits $CRL_1$ to $CRL_n$ and the additional clock signal control circuit $CRL_x$ of the simple configuration without the necessity of providing an additional detection circuit, preventing the circuit size from unduly increasing. Also, since a large circuit for controlling the supply of the clock signal CLK is not required, the reliability at the mounting improves and the fabrication cost can be advantageously reduced.

In this example, the additional circuit block $BLK_x$ was provided downstream of the last circuit block $BLK_n$. However, this is not indispensable.

EXAMPLE 2

Figure 6:
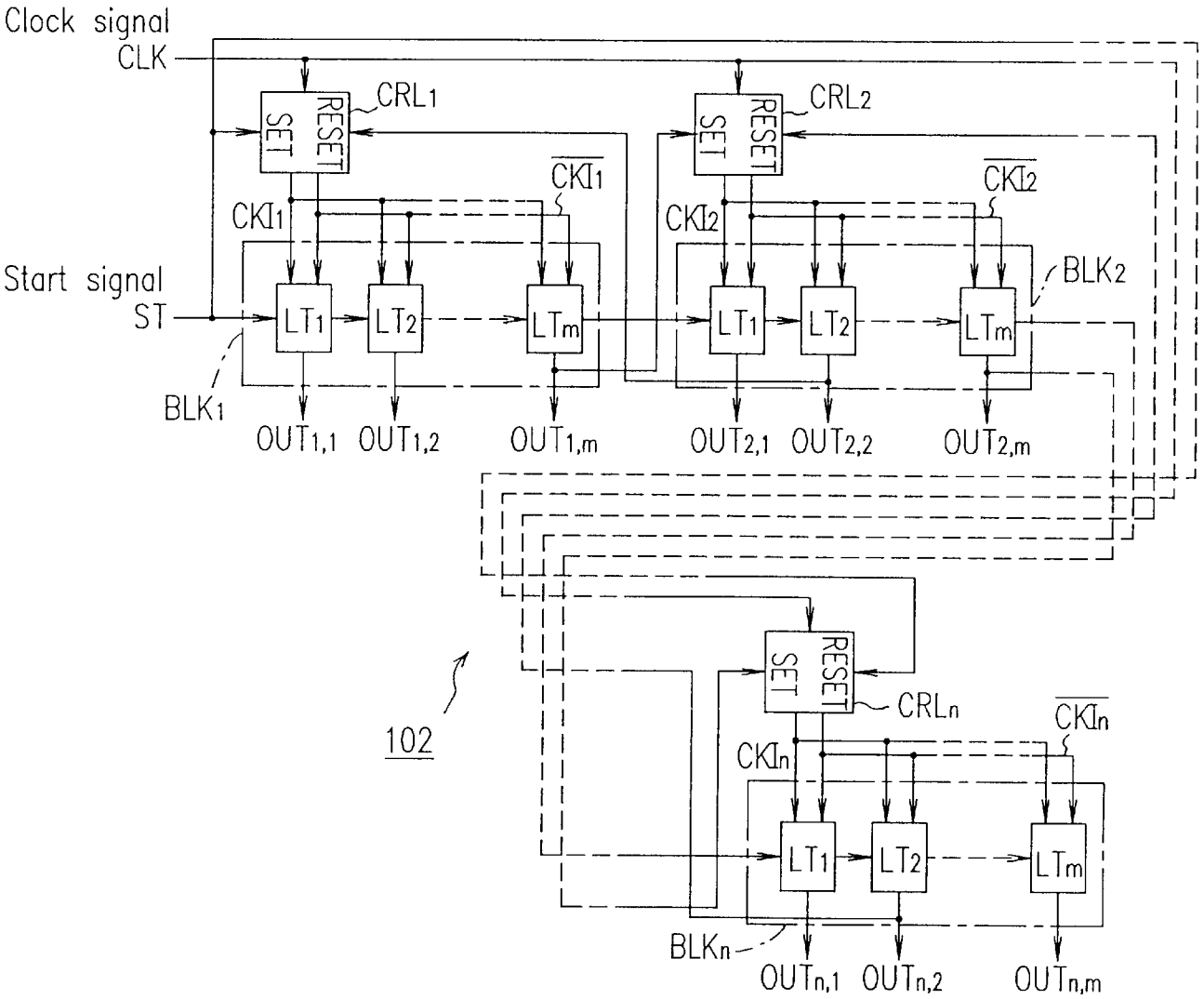
FIG. 6 is a block diagram showing a shift register of Example 2 according to the present invention in detail.

FIG. 6 shows a shift register of Example 2 according to the present invention. The configuration of a shift register 102 of this example is the same as that of the shift register 101 of Example 1, except that the additional circuit block $BLK_x$ of the shift register 101 is omitted in this example. With this omission, increases in the circuit size can be further prevented.

In Example 2, the start signal ST is input into the reset terminal RESET of the clock signal control circuit $CRL_n$. In Example 1, after the transfer operation of the last circuit block $BLK_n$ is completed, the clock signal CLK is supplied only to the latch circuits $LT_1$ and $LT_2$ in the additional circuit block $BLK_x$ until the start signal ST becomes high again. In Example 2, however, the clock signal CLK is continuously supplied to the latch circuits $LT_1$ to $LT_m$ of the last circuit block $BLK_n$ even after the transfer operation is completed. When the cycle of the start signal ST is long, therefore, the effect of saving the power consumption is somewhat reduced.

In Examples 1 and 2, the output signal $OUT_{i-1,m}$ from the last latch circuit $LT_m$ in the preceding circuit block $BLK_{i-1}$ is input into the set terminal SET of the clock signal control circuit $CRL_i$ corresponding to the circuit block $BLK_i$. Alternatively, the output signal $OUT_{i-1,j}$ from the latch circuit $LT_j$ upstream of the latch circuit $LT_m$ in the circuit block $BLK_{i-1}$ may be used. Using such an earlier output signal is advantageous in the case where the signal delay at the clock signal control circuit $CRL_i$ is not sufficiently short compared with the cycle of the clock signal CLK. As a result, using such an earlier output signal, it is ensured that the transfer operation of the circuit block $BLK_i$ can be initiated while the output signal $OUT_{i-1,m}$ from the last latch circuit $LT_m$ in the preceding circuit block $BLK_{i-1}$ is at a high level. It should be noted, however, that using the output signal $OUT_{i-1,j}$ from the latch circuit $LT_j$ which is located at an unnecessarily earlier stage results in initiating the transfer operation of the circuit block $BLK_i$ unnecessarily early and thereby blocking the effect of saving the power consumption.

In the shift registers of Examples 1 and 2, the output signal $OUT_{i+1,2}$ from the second latch circuit $LT_2$ in the subsequent circuit block $BLK_{i+1}$ is input into the reset terminal RESET of the clock signal control circuit $CRL_i$ corresponding to the circuit block $BLK_i$. Alternatively, the output signal $OUT_{i+1,j}$ from the latch circuit $LT_j$ downstream of the latch circuit $LT_2$ in the circuit block $BLK_{i+1}$ may be used. Using such a later output signal is advantageous in the case where the start signal ST is kept at a high level over one cycle of the clock signal CLK or the start signal ST has a plurality of high-level pulse portions within one cycle. As a result, using such a later signal, it is ensured that all the pulse portions of the start signal ST can be transferred. It should be noted, however, that using the output signal $OUT_{i+1,j}$ from the latch circuit $LT_j$ which is located at an unnecessarily later stage results in terminating the transfer operation of the circuit block $BLK_i$ unnecessarily late and thereby blocking the effect of saving the power consumption. Moreover, when the pulse portion of the start signal ST is long or the start signal ST has a plurality of high-level pulse portions as described above, such a pulse portion should be shorter than the period corresponding to one circuit block and the low-level portion of the start signal ST should be kept for at least the period corresponding to one circuit block.

The shift registers of Examples 1 and 2 are especially effective when polysilicon TFTs are used, though they are still effective when single crystalline silicon transistors are used. The reason is that since polysilicon TFTs have inferior device characteristics compared with single crystalline silicon transistors, a larger device size is required for the polysilicon TFTs, resulting in increasing the circuit capacitances. Also, due to the inferior device characteristics, a higher driving voltage is required for the polysilicon TFTs, resulting in increasing the power consumption required for the clock signal CLK.

Figure 7:
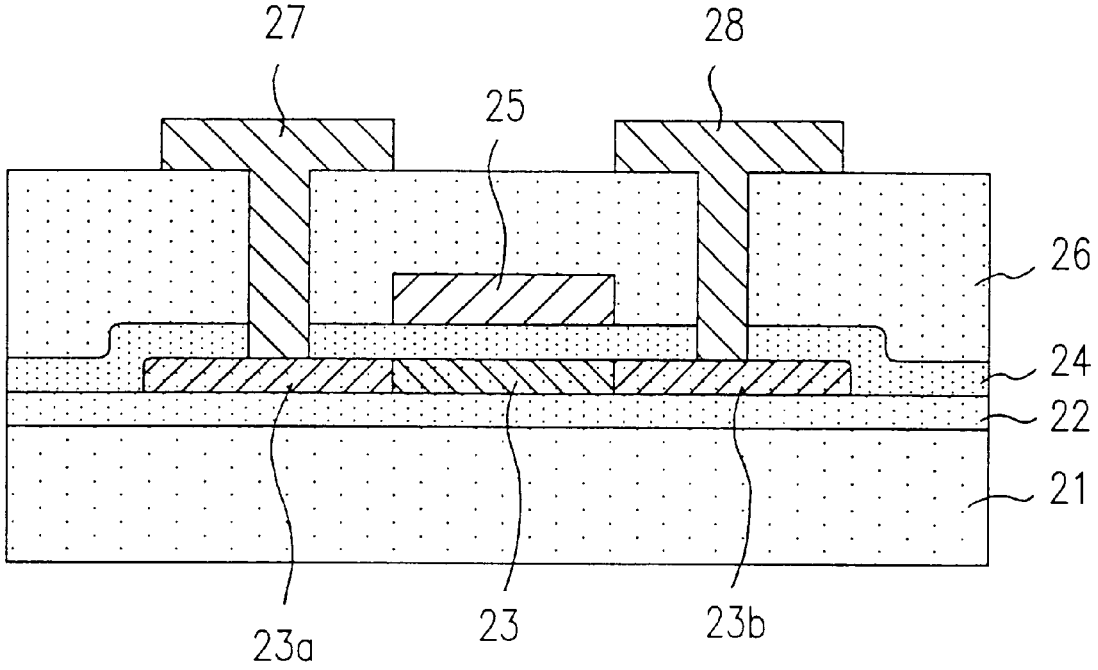
FIG. 7 is a longitudinal sectional view of a polysilicon thin film transistor used as a transistor for the shift registers of Example 1 or 2.

Referring to FIG. 7, a polysilicon TFT includes a polysilicon thin film 23 formed on an insulating transparent substrate 21 via a silicon oxide film 22. A gate electrode 25 is formed above the polysilicon thin film 23 via a silicon oxide film 24 which is to be a gate oxide film. The entire surface of the resultant structure is covered with a silicon oxide film 26 as a protection film. A source electrode 27 and a drain electrode 28 are formed through the silicon oxide films 24 and 26 to be in contact with a source region 23*a* and a drain region 23*b* of the polysilicon thin film 23.

EXAMPLE 3

In Example 3, an active matrix image display apparatus according to the present invention will be described. In the image display apparatus of Example 3, the shift register 101 or 102 of Example 1 or 2 is used for the shift register of at least one of the data signal line driver 32*c* and the scanning signal line driver 33*c* of the active matrix liquid crystal display apparatus 400 shown in FIG. 8.

According to the shift register of the image display apparatus of this example, since only one pulse of the start signal is transferred in one horizontal scanning period or one vertical scanning period, substantially only one circuit block $BLK_i$ requires the transfer operation at any time. This saves the power consumption in the driver. Since each of the drivers 32*c* and 33*c* is formed as an IC on a single crystalline silicon substrate, the shift register is composed of single crystalline silicon transistors.

In the active matrix image display apparatus of this example, the data clock signal CKS for the data signal line driver 32*c* has a frequency several hundreds to about one thousand of times (640 times for the VGA standard, 1024 times for the XGA standard) higher than the scanning clock signal CKG for the scanning signal line driver 33*c*. Therefore, a significant effect can be obtained by providing the data signal line driver 32*c* with the shift register according to the present invention which is divided into circuit blocks to selectively drive each circuit block. Also, since the shift register of the scanning signal line driver 33*c* includes a large number of stages (480 stages for the VGA standard, 768 stages for the XGA standard), the effect of saving the power consumption can be sufficiently obtained by providing the scanning signal line driver 33*c* with the shift register according to the present invention which is divided into circuit blocks to selectively drive each circuit block.

EXAMPLE 4

In Example 4, another active matrix image display apparatus according to the present invention will be described.

Figure 9:
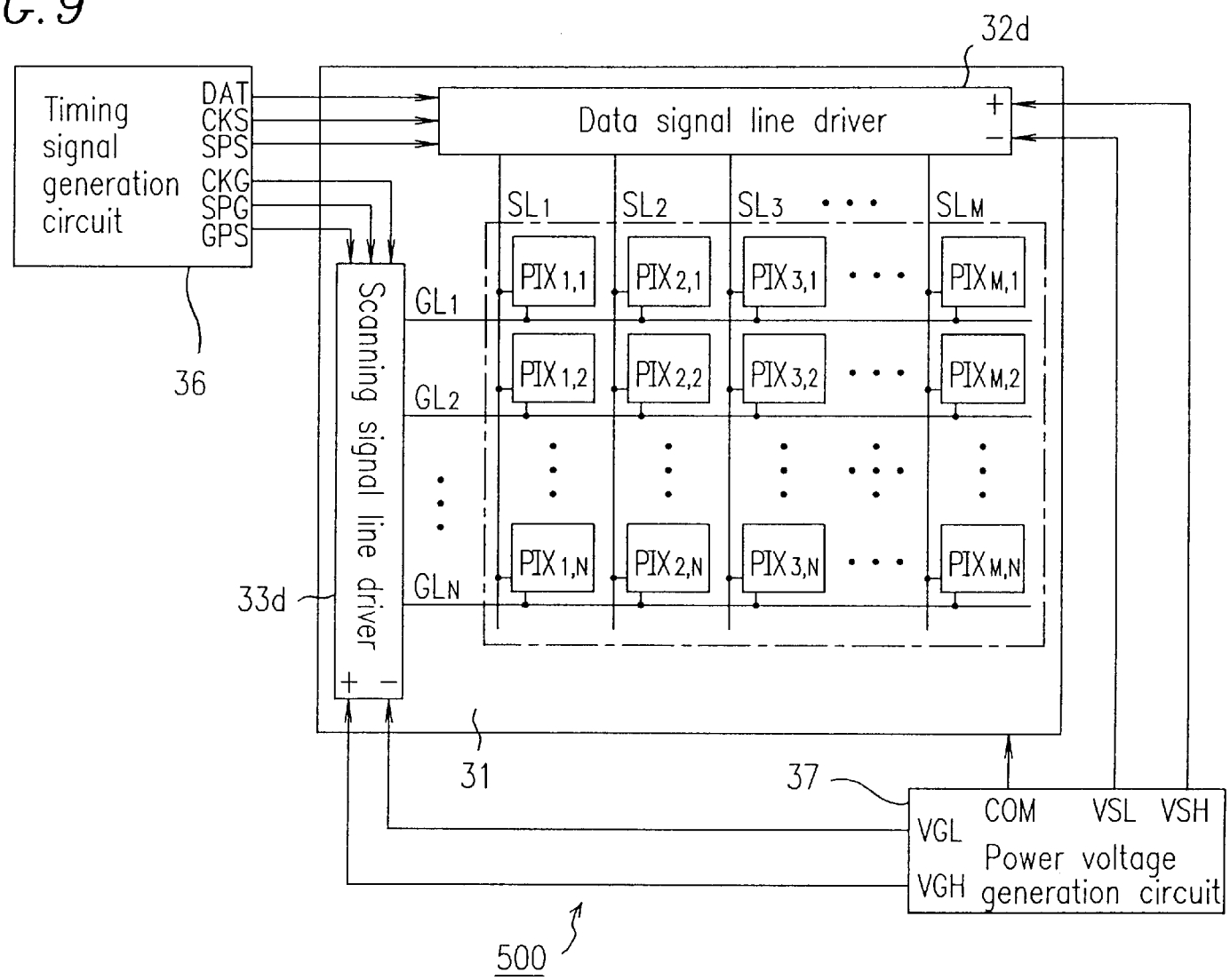
FIG. 9 is a block diagram schematically showing an active matrix image display apparatus of Example 4 according to the present invention.

In the image display apparatus of Example 4, the shift register 101 or 102 of Example 1 or 2 is used as the shift register of at least one of the data signal line driver 32*d* and the scanning signal line driver 33*d* of the active matrix liquid crystal display apparatus 500 shown in FIG. 9.

According to the image display apparatus of this example, the data signal line driver 32*d* and the scanning signal line driver 33*d* are formed on one of the substrates constituting the liquid crystal panel 31, together with the elements constituting the pixels. The shift register is composed of polysilicon TFTs formed on the transparent substrate of the liquid crystal panel 31.

In Example 4, the latch circuits in each circuit block are composed of polysilicon TFTs which have larger gate capacitances and have inferior device characteristics compared with single crystalline silicon transistors as described above, and thus require large power consumption. Accordingly, in addition to the effect described in Example 3, the image display apparatus of this example using the shift register according to the present invention which is divided into circuit blocks to selectively drive each circuit block can obtain the effect of saving the power consumption further significantly.

EXAMPLE 5

Examples 5 to 9 below are based on one of the common basic principles of the present invention. Hereinbelow, this principle will be described with reference to FIG. 10.

Each latch circuit of the shift registers of Examples 1 and 2 is configured to effect positive feedback as is observed from FIG. 3. Therefore, the output of the latch circuit may be active depending on the internal state thereof when the apparatus is turned on.

In Examples 1 and 2, each clock signal control circuit controls whether the supply of the clock signal to the corresponding circuit block should be initiated and terminated by using output pulses from specific latch circuits in the preceding and subsequent circuit blocks. Accordingly, if the specific latch circuit in the subsequent circuit block used for this control is active when the apparatus is turned on, the clock signal control circuit continuously receives the reset signal. This blocks the clock signal from being input into the corresponding circuit block. As a result, the start signal is no longer transferred through the circuit blocks downstream of this circuit block in the shift register.

In order to overcome the above problem, the outputs of all the latch circuits constituting the shift register should be compulsively made inactive at least when the apparatus is turned on.

Figure 10:
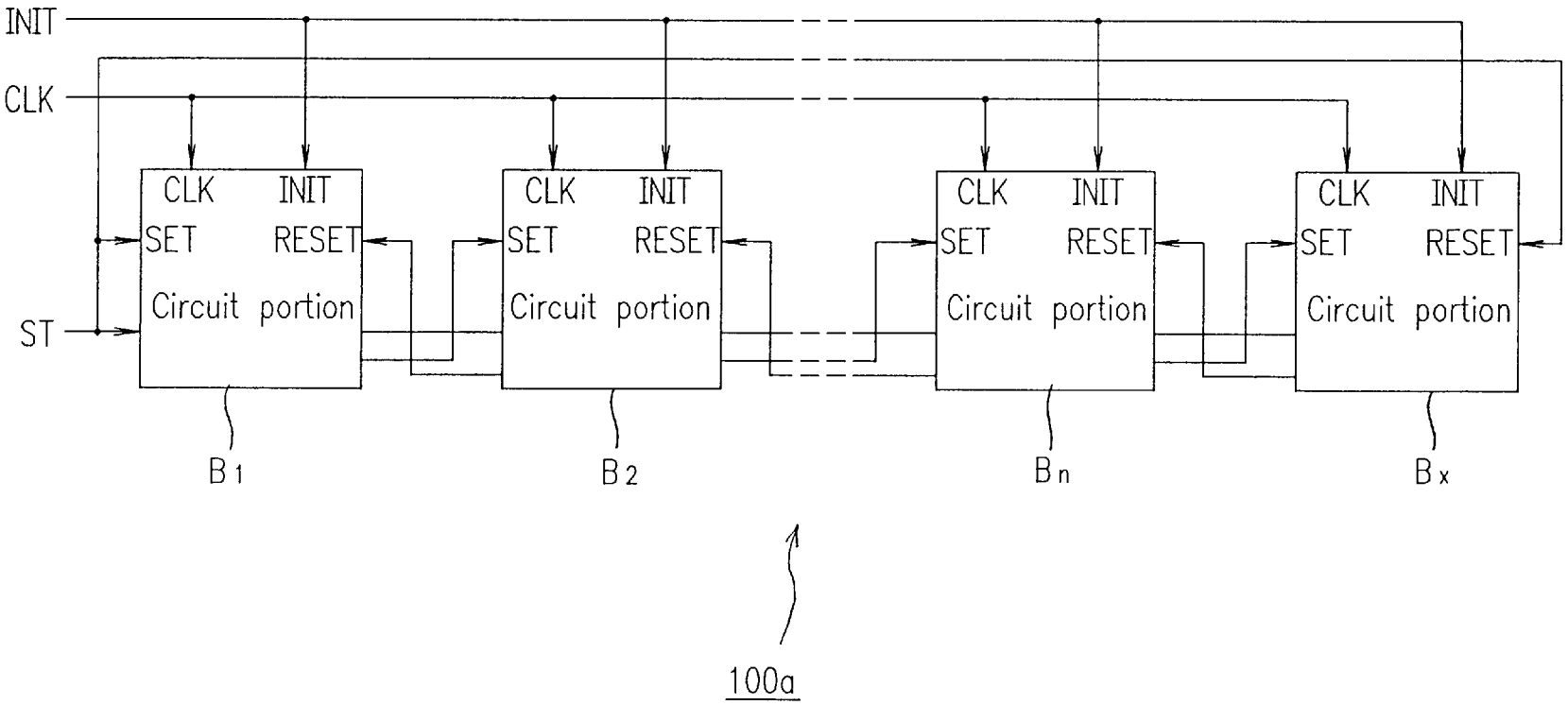
FIG. 10 is a view for describing a basic principle common to shift registers of Examples 5 to 9 according to the present invention.

In FIG. 10, circuit portions $B_1$ to $B_n$ and $B_x$ collectively include the clock signal control circuits $CRL_1$ to $CRL_n$ and $CRL_x$ and the circuit blocks $BLK_1$ to $BLK_n$ and $BLK_x$ shown in FIG. 1, respectively. In a shift register 100*a* of the present invention shown in FIG. 10, an initialization signal INIT is input into the circuit portions $B_1$ to $B_n$ and $B_x$ to compulsively make inactive the outputs of all the latch circuits included in the circuit portions. Alternatively, all the clock signal control circuits may be made to supply the clock signal to the corresponding circuit blocks in response to the initialization signal INIT. With this configuration, the above malfunction can be prevented.

Figure 11:
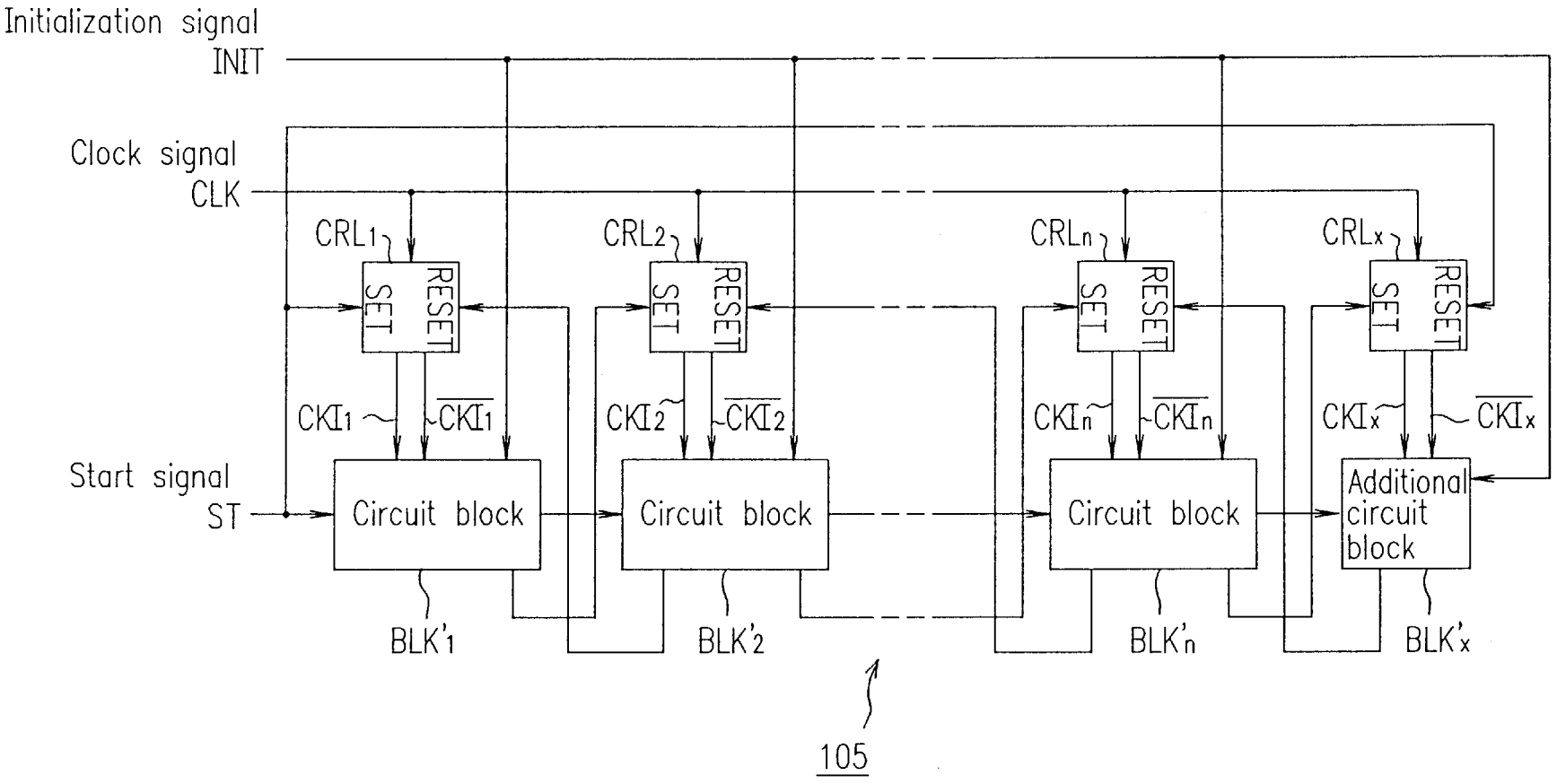
FIG. 11 is a block diagram of a shift register of Example 5 according to the present invention.
Figure 12:
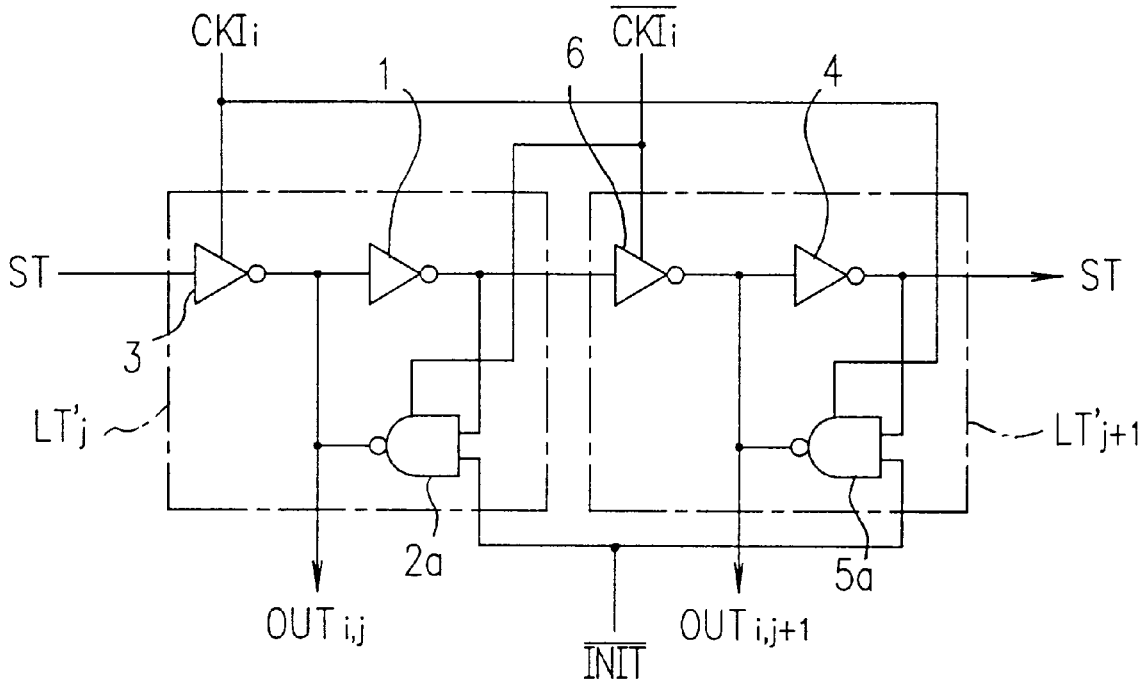
FIG. 12 is a diagram of two adjacent latch circuits of the shift register of Example 5.

FIG. 11 is a block diagram of a shift register of Example 5 according to the present invention. FIG. 12 shows a configuration of two adjacent latch circuits $LT'_j$ and $LT'_{j+1}$ in a circuit block constituting the shift register of FIG. 11.

Referring to FIG. 11, a shift register 105 of this example includes circuit blocks $BLK'_1$, to $BLK'_n$ and $BLK'_x$ which receive an initialization signal INIT in addition to the start signal ST and the internal clock signals $CKI_1$ to $CKI_n$, $CKI_x$, $CKI_1$ bar to $CKI_n$ bar, and $CKI_x$ bar, in place of the circuit blocks $BLK_1$ to $BLK_n$ and $BLK_x$ of the shift register 101 shown in FIG. 1. With the receipt of the initialization signal INIT, the outputs of the latch circuits in each circuit block are inactivated compulsively.

Like the circuit block $BLK_i$ of the shift register 101 shown in FIG. 1, each circuit block $BLK'_i$ ($1 \leqq i < n$; i is an integer) is composed of m latch circuits connected in series. Referring to FIG. 12, the two adjacent latch circuits $LT'_j$ and $LT'_{j+1}$ include inverters 1 and 4, clocked inverters 3 and 6 (synchronous inverters), and clocked NAND circuits (synchronous NAND circuits) 2*a* and 5*a*, respectively. The internal clock signal $CKI_i$ is input into the clocked inverter 3 and the clocked NAND circuit 5*a*, while the inverted internal clock signal $CKI_i$ bar is input into the clocked inverter 6 and the clocked NAND circuit 2*a*, as synchronous signals. The clocked NAND circuits 2*a* and 5*a* also receive the initialization signal INIT and the outputs of the inverters 1 and 4, respectively. In other words, in the latch circuits $LT'_j$ and $LT'_{j+1}$, the clocked inverters 2 and 5 constituting the flipflops in the latch circuit $LT_j$ and $LT_{j+1}$ shown in FIG. 3 are replaced with the clocked NAND circuits 2*a* and 5*a*.

With the above configuration, the outputs of all the latch circuits can be inactivated at least when the apparatus is turned on by supplying an initialization signal (in this case, a negative logic signal) to all the latch circuits. As a result, the above-mentioned trouble associated with the reset signal is continuously input into the clock signal control circuit $CRL_{i-1}$ corresponding to the preceding circuit block $BLK'_{i-1}$ can be overcome, and thus the above malfunction can be prevented.

In Example 5, the scanning pulse (start signal ST) for the shift register 105 is positive logic while the initialization signal INIT is negative logic. When the scanning pulse (start signal ST) for the shift register 105 is negative logic (reverse sign), the clocked NAND circuit should be replaced with a clocked NOR circuit (synchronous NOR circuit) and an initialization signal of positive logic should be used. In this case, additionally, the same effect as that described above can be obtained.

EXAMPLE 6

Figure 13:
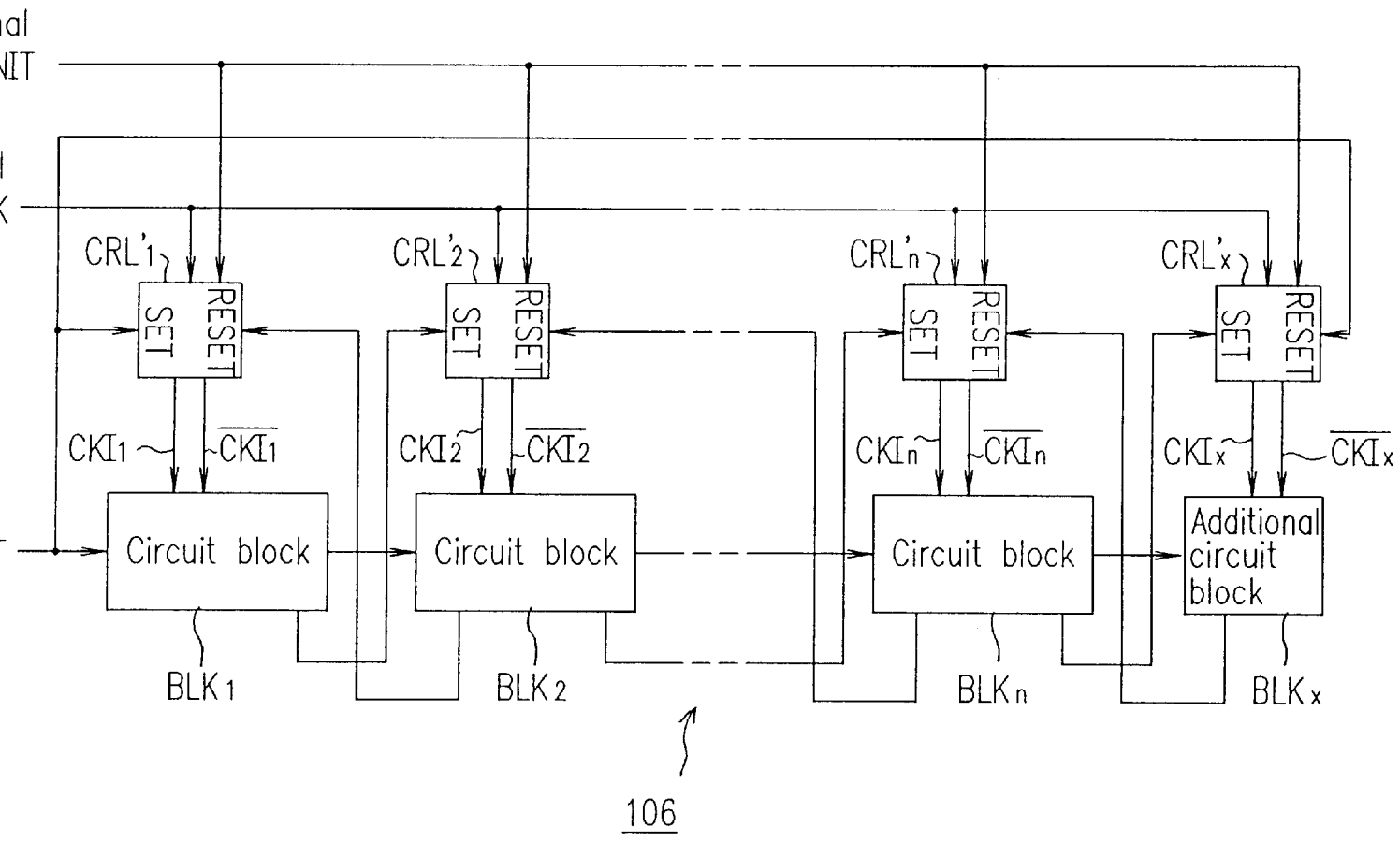
FIG. 13 is a block diagram of a shift register of Example 6 according to the present invention.
Figure 14:
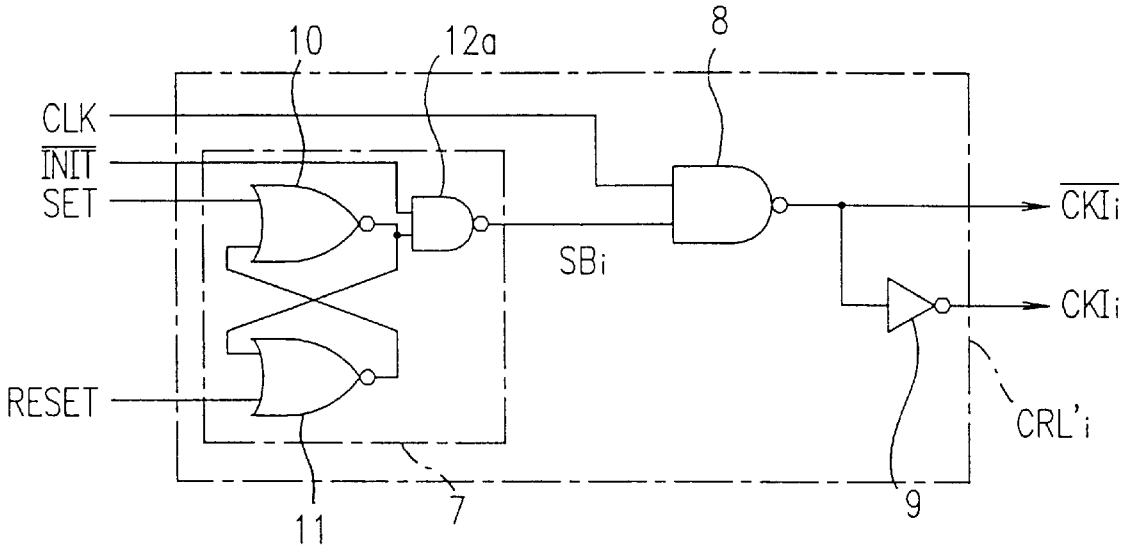
FIG. 14 is a block diagram of a clock signal control circuit of the shift register of Example 6.

FIG. 13 is a block diagram of a shift register of Example 6 according to the present invention. FIG. 14 shows a configuration of a clock signal control circuit of the shift register of FIG. 13 in detail.

Referring to FIG. 13, a shift register 106 of this example includes clock signal control circuits $CRL'_1$ to $CRL'_n$ and $CRL'_x$ which receive an initialization signal INIT in addition to the clock signal CLK, in place of the clock signal control circuits $CRL_1$ to $CRL_n$ and $CRL_x$ of the shift register 101 of Example 1. With the receipt of the initialization signal INIT, the clock signal control circuits $CRL'_1$ to $CRL'_n$ and $CRL'_x$ are put in a state where the clock signal can be supplied to all the latch circuits irrespective of the states of the set terminals SET and the reset terminals RESET.

Referring to FIG. 14, each clock signal control circuit $CRL'_i$ is different from the clock signal control circuit $CRL_i$ of the shift register 101 of Example 1 shown in FIG. 4 in that a NAND circuit 12*a* is provided in place of the inverter 12.

That is, the clock signal control circuit $CRL'_i$ includes a flipflop circuit 7, a NAND gate 8, and an inverter 9. The flipflop circuit 7 includes a RS flipflop circuit obtained by interconnecting an input of each of two NOR gates 10 and 11 with the output of the other NOR gate 10 or 11. The other input of the NOR gate 10 is connected with the set terminal SET, while the other input of the NOR gate 11 is connected with the reset terminal RESET. The NAND circuit 12*a* receives the output of the NOR gate 10 and the initialization signal INIT, and outputs a block selection signal $SB_i$. In this case, a negative logic initialization signal INIT bar is used. The additional clock signal control circuit $CRL'_x$ has the same configuration as the clock signal control circuit $CRL'_i$.

With the above configuration, the initialization signal (in this case, a negative logic signal) is input into all the clock signal control circuits $CRL'_1$ to $CRL'_n$ and $CRL'_x$ at least when the apparatus is turned on, so that the clock signal can be supplied to all the latch circuits irrespective of whether the flipflop circuit 7 is in the set or reset state.

By transferring the pulse signal (start signal ST) under the above state, the outputs of all the latch circuits are inactivated after one scanning period. In the subsequent scanning periods, therefore, the above-mentioned trouble associated with a failure in the transfer of the start signal through the shift register can be prevented.

In Example 6, unlike Example 5, the general latch circuits can be used. The shift register of Example 6 is therefore advantageous over that of Example 5 in the aspect of operation speed.

In Example 5, the initialization signal is input into only the latch circuits, while, in Example 6, it is input into only the clock signal control circuits. Alternatively, the initialization signal may be input into both the latch circuits and the clock signal control circuits, so that the outputs of all the latch circuits are inactivated and all the clock signal control circuits are put in the state where the clock signal can be supplied to the corresponding latch circuits.

EXAMPLE 7

Figure 15:
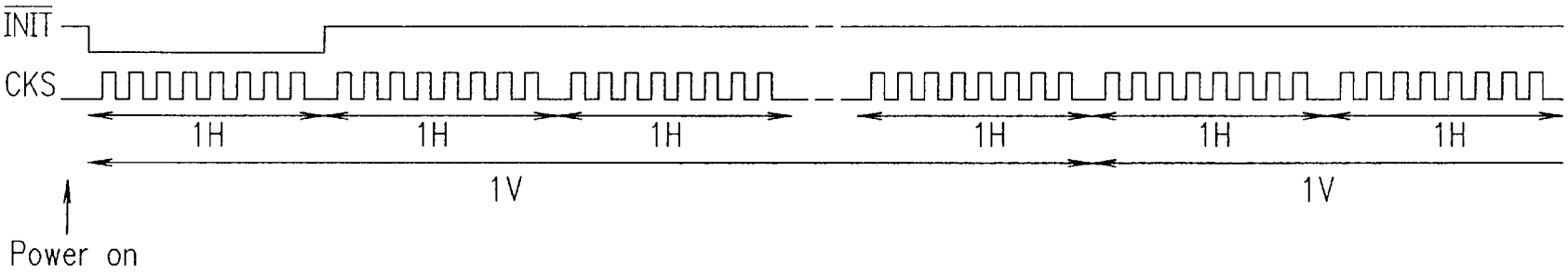
FIG. 15 shows a waveform of an initialization signal for an image display apparatus of Example 7 according to the present invention.

FIG. 15 is a timing chart for describing an image display apparatus of Example 7 according to the present invention.

Figure 8:
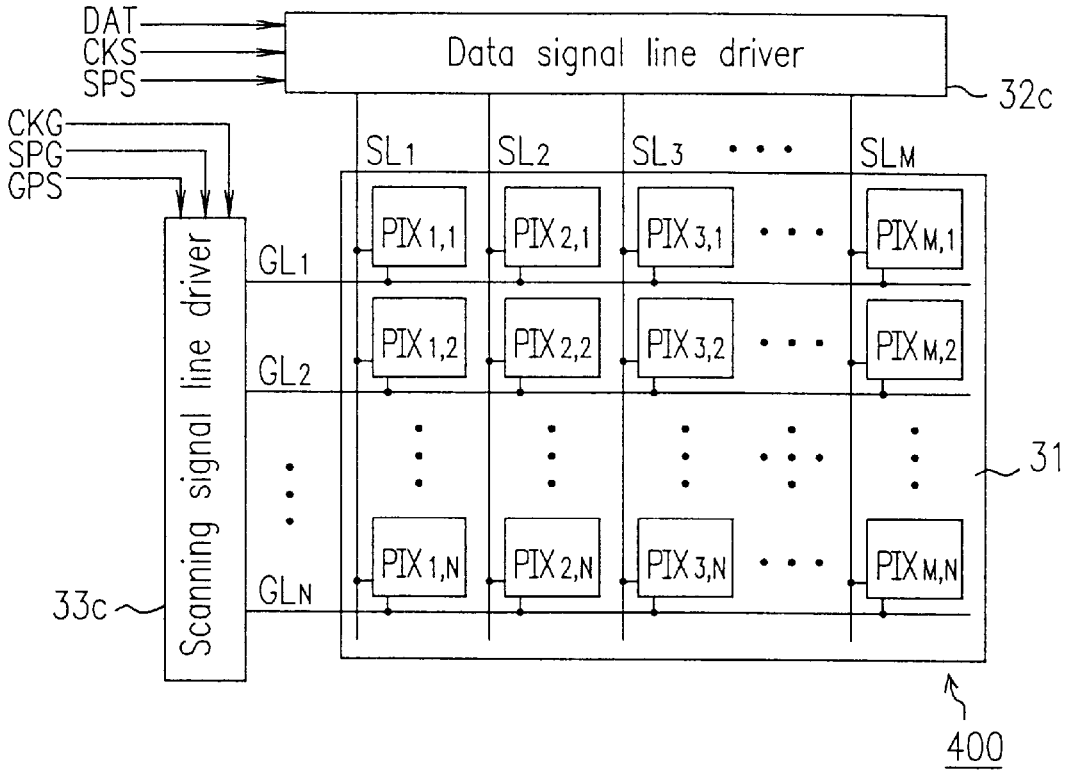
FIG. 8 is a block diagram schematically showing an active matrix image display apparatus of Example 3, 7, 8, or 9 according to the present invention.

In the image display apparatus of Example 7, the shift register 105 (FIG. 11) or 106 (FIG. 13) of Example 5 or 6 is used as the shift register of the data signal line driver 32*c* of the active matrix liquid crystal display apparatus 400 shown in FIG. 8. The image display apparatus of Example 7 uses an initialization signal INIT having a waveform shown in FIG. 15 which is active (low) only for the first horizontal period after the apparatus is turned on.

With the input of the above initialization signal, the outputs of all the latch circuits of the shift register are inactivated during the first horizontal scanning period after the apparatus is turned on. This allows the shift register to normally operate in the subsequent horizontal scanning periods until the apparatus is inactivated.

In Example 7, the shift register 105 or 106 of Example 5 or 6 was applied to the data signal line driver 32*c*. The shift register 105 or 106 can also be applied to the scanning signal line driver 33*c* of the liquid crystal display apparatus 400. In this case, the initialization signal INIT should be a negative logic signal which is active (low) only for the first vertical scanning period after the apparatus is turned on. The same effect as that described above can be obtained.

EXAMPLE 8

Figure 16:
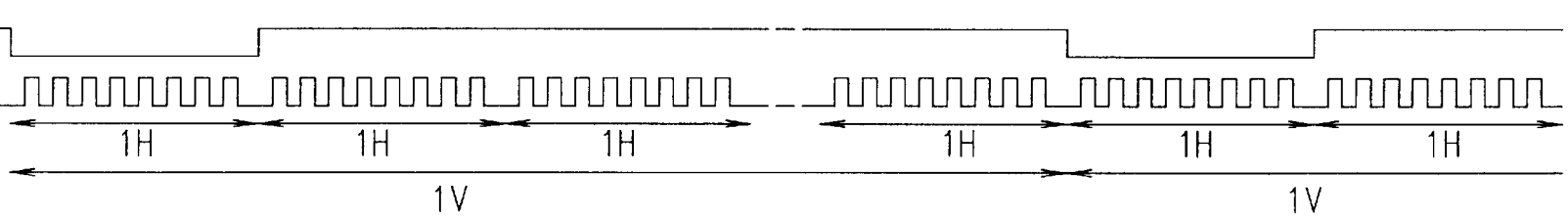
FIG. 16 shows a waveform of an initialization signal for an image display apparatus of Example 8 according to the present invention.

FIG. 16 is a timing chart for describing an image display apparatus of Example 8 according to the present invention.

In the image display apparatus of Example 8, the shift register 105 or 106 of Example 5 or 6 is used as the shift register of the data signal line driver 32*c* of the active matrix liquid crystal display apparatus 400 shown in FIG. 8. The image display apparatus of Example 8 uses an initialization signal INIT having a waveform shown in FIG. 16 which should be a negative logic signal and is active (low) only for the first horizontal scanning period in a vertical scanning retrace interval after every vertical scanning period.

With the input of the above initialization signal, the outputs of all the latch circuits of the shift register are inactivated during the first horizontal scanning period in every vertical scanning retrace interval. This allows the shift register to operate substantially normally after the apparatus is turned on.

Thus, in Example 8, the initialization signal is input into the shift register not only when the apparatus is turned on but also after every vertical scanning period. With this configuration, a mechanism for detecting the activation (i.e., power-on) of the apparatus which is required for the configuration where the initialization signal is input into the shift register only when the apparatus is turned on is not necessary. This simplifies the peripheral configuration of the shift register.

In Example 8, the shift register 105 or 106 of Example 5 or 6 was applied to the data signal line driver 32*c*. The shift register 105 or 106 can also be applied to the scanning signal line driver 33*c* of the liquid crystal display apparatus 400. In this case, the same effect as that described above can be obtained.

EXAMPLE 9

Figure 17:
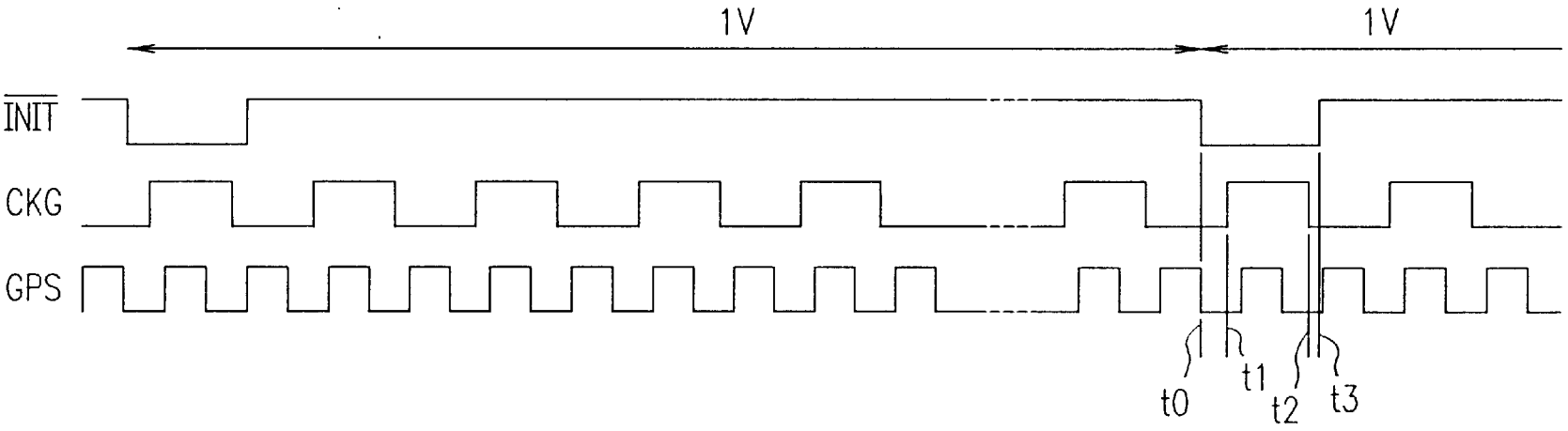
FIG. 17 shows a waveform of an initialization signal for an image display apparatus of Example 9 according to the present invention.
Figure 18:
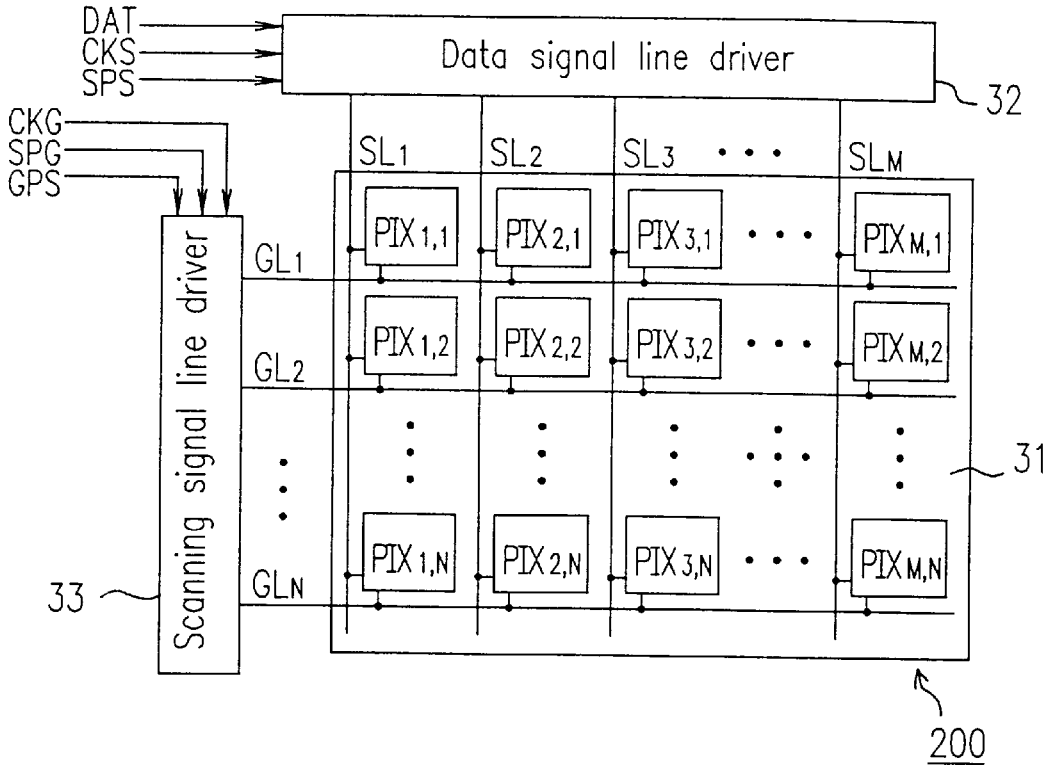
FIG. 18 is a block diagram schematically showing a conventional active matrix image display apparatus.
Figure 19:
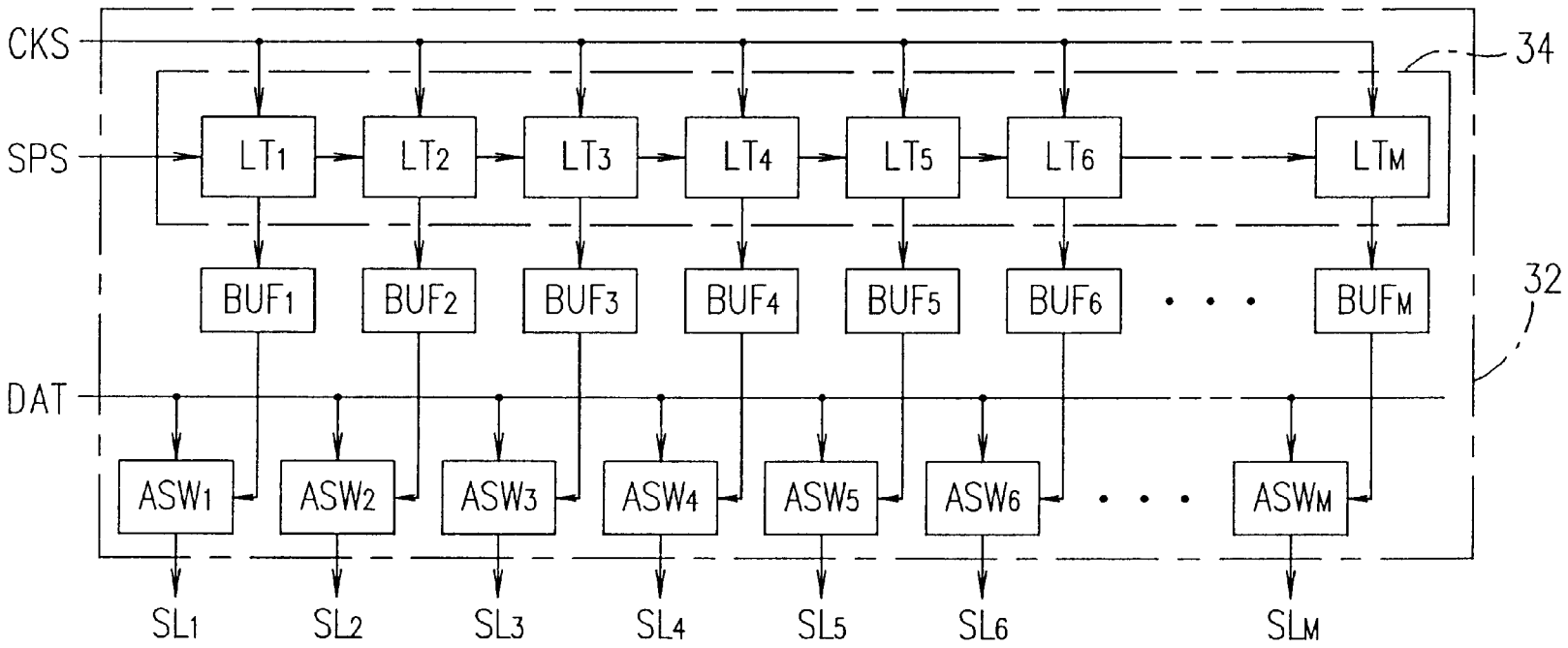
FIG. 19 is a block diagram of a data signal line driver of the conventional image display apparatus.
Figure 20:
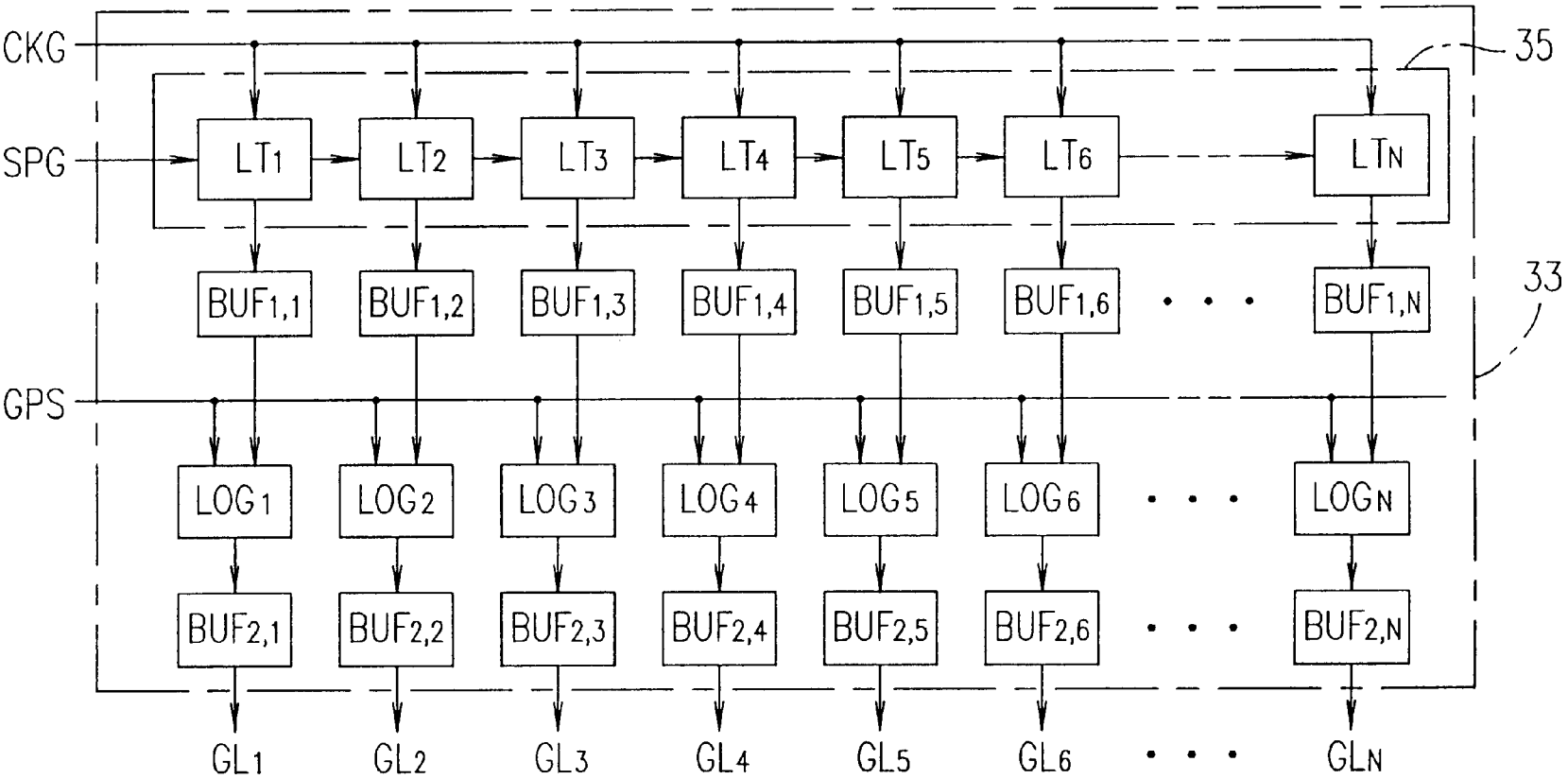
FIG. 20 PRIOR ART
FIG. 20 is a block diagram of a scanning signal line driver of the conventional image display apparatus.
Figure 21:
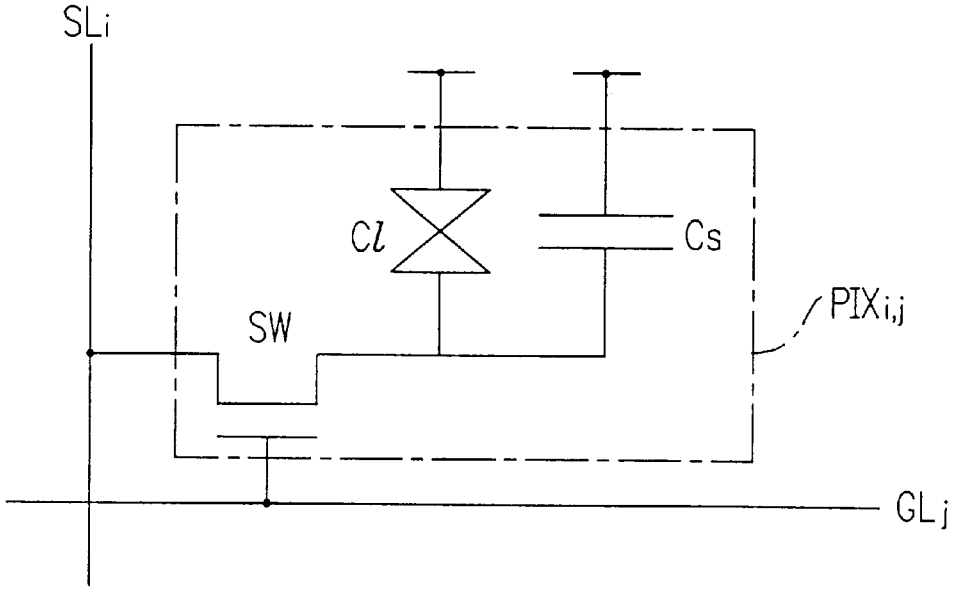
FIG. 21 shows a configuration of a pixel of a liquid crystal panel of the conventional active matrix image display apparatus.
Figure 22:
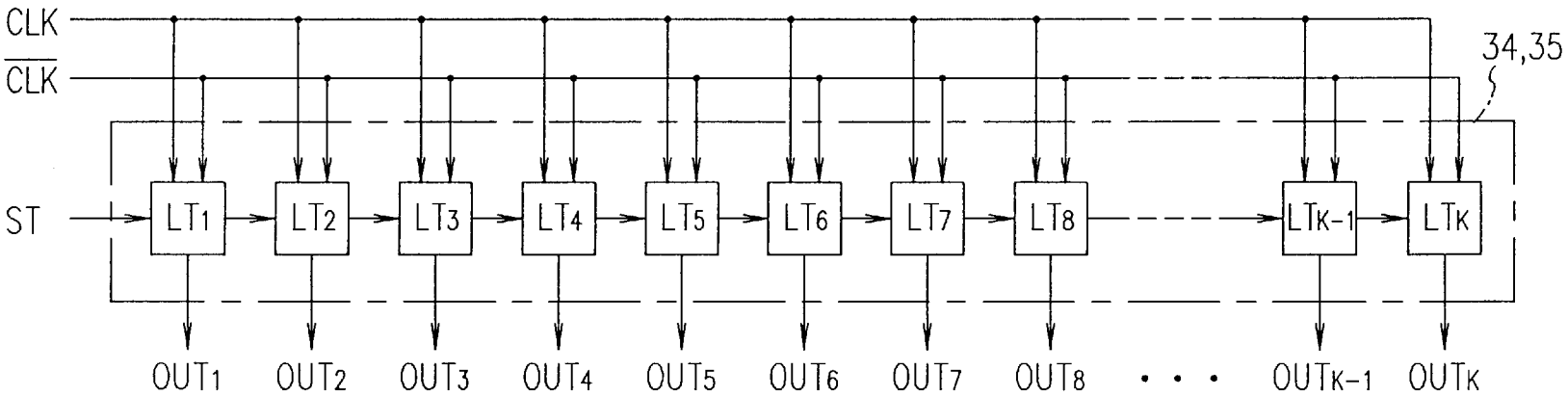
FIG. 22 PRIOR ART
FIG. 22 is a block diagram of a shift register used for the data signal line driver and the scanning signal line driver of the conventional image display apparatus.

FIG. 17 is a timing chart for describing an image display apparatus of Example 9 according to the present invention.

In the image display apparatus of Example 9, the shift register 105 or 106 of Example 5 or 6 is used as the shift registers of the data signal line driver 32*c* and/or the scanning signal line driver 33*c* of the active matrix liquid crystal display apparatus 400 shown in FIG. 8. The image display apparatus of Example 9 uses the start pulse (scanning start signal SPG) for vertical scanning as the initialization signal INIT for horizontal scanning.

As shown in FIG. 17, a falling timing $t_0$ of the negative logic initialization signal INIT precedes a rising (or falling) timing $t_1$ of the clock signal CKG for vertical scanning, and a rising timing $t_3$ of the initialization signal INIT follows a falling (or rising) timing $t_2$ of the clock signal CKG for vertical scanning. This setting is necessary because, in order to inactivate the internal nodes of all the latch circuits in Example 7, the initialization signal should be ensured to be continuously input over one horizontal scanning period (i.e., a half cycle of the clock signal CKG for the scanning signal line driver).

With the input of the initialization signal, the outputs of all the latch circuits can be inactivated within one horizontal scanning period. Thus, the shift register can substantially normally operate after the apparatus is turned on.

By using the vertical scanning start signal SPG as the initialization signal, neither a mechanism for detecting the activation (i.e., power-on) of the apparatus as in Example 7, nor a new initialization signal as in Examples 7 and 8 are required. This simplifies the peripheral configuration of the shift register.

Thus, according to the present invention, the clock signal is sequentially supplied only to a circuit block of the shift register which currently requires the transfer operation. Accordingly, the power consumption required for parasitic capacitances of signal lines and gate capacitances of the latch circuits can be greatly reduced compared with the case where the clock signal is supplied to the entire shift register. Moreover, the supply of the clock signal to each circuit block can be controlled by the corresponding clock signal control circuit with a simple configuration based on output signals from the preceding and subsequent circuit blocks. This prevents the size of the shift register from unduly increasing.

An image display apparatus with reduced power consumption capable of displaying high-quality images can be realized by applying the shift register of the present invention to the data signal line driver and/or the scanning signal line driver of a conventional active matrix image display apparatus.

According to the present invention, the outputs of all the latch circuits of the shift register are compulsively inactivated by supplying an initialization signal. With this configuration, the above-mentioned trouble that the clock signal control circuit corresponding to the preceding circuit block is reset when the apparatus is turned on due to the output from a specific latch circuit in the current circuit block, can be prevented, and thus malfunction due to this resetting of the clock signal control circuit, i.e., failure in the transfer of the start signal through the shift register, can be prevented.

According to the present invention, all the clock signal control circuits of the shift register are put in the state where the clock signal can be supplied to the corresponding circuit blocks. With this configuration, also, the above trouble can also be prevented.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A shift register for sequentially transferring a digital signal in synchronization with a clock signal, comprising:

a plurality of circuit blocks connected in series, each including a prescribed number of sequential latch circuits, each latch circuit outputting a signal corresponding to an input signal based on the clock signal; and a plurality of clock signal control circuits provided for the respective circuit blocks for controlling the supply of the clock signal to the latch circuits in the corresponding circuit blocks, wherein the control of the supply of the clock signal by each of the clock signal control circuits to the latch circuits in the corresponding circuit block is conducted in response to output signals from prescribed latch circuits in the circuit blocks preceding and subsequent to the corresponding circuit block.

2. A shift register according to claim 1, wherein each of the clock signal control circuits initiates the supply of the clock signal to the latch circuits in the corresponding circuit block in response to an output signal from one of the latch circuits in the preceding circuit block, and terminates the supply of the clock signal to the latch circuits in the corresponding circuit block in response to an output signal from one of the latch circuits downstream of the first latch circuit in the subsequent circuit block.

3. A shift register according to claim 1, wherein a transistor included in the latch circuit is a thin film transistor including a polysilicon layer.

4. An active matrix image display apparatus using a shift register according to claim 1, comprising:

a liquid crystal panel including a plurality of pixels arranged in columns and rows, a plurality of data signal lines disposed for the columns of the pixels, and a plurality of scanning signal lines disposed for the rows of the pixels, image data for image display being supplied from the data signal lines to the pixels in synchronization with a scanning signal supplied from the scanning signal lines;

a data signal line driver for sequentially outputting the image data to the plurality of data signal lines in synchronization with a prescribed timing signal; and a scanning signal line driver for sequentially outputting the scanning signal to the plurality of scanning signal lines in synchronization with a prescribed timing signal, wherein the data signal line driver includes the shift register as a circuit for sequentially shifting a sampling signal for receiving the image data in correspondence with the data signal lines.

5. An active matrix image display apparatus using a shift register according to claim 1, comprising:

a liquid crystal panel including a plurality of pixels arranged in columns and rows, a plurality of data signal lines disposed for the columns of the pixels, and a plurality of scanning signal lines disposed for the rows of the pixels, image data for image display being supplied from the data signal lines to the pixels in synchronization with a scanning signal supplied from the scanning signal lines;

a data signal line driver for sequentially outputting the image data to the plurality of data signal lines in synchronization with a prescribed timing signal; and a scanning signal line driver for sequentially outputting the scanning signal to the plurality of scanning signal lines in synchronization with a prescribed timing signal, wherein the scanning signal line driver includes the shift register as a circuit for sequentially shifting the scanning signal in correspondence with the scanning signal lines.

6. An active matrix image display apparatus according to claim 4, wherein at least one of the data signal line driver and the scanning signal line driver includes elements formed on a substrate constituting the liquid crystal panel as circuit elements constituting the driver, together with elements constituting the pixels.

7. An active matrix image display apparatus according to claim 5, wherein at least one of the data signal line driver and the scanning signal line driver includes elements formed on a substrate constituting the liquid crystal panel as circuit elements constituting the driver, together with elements constituting the pixels.

8. A shift register according to claim 1, wherein the outputs of the latch circuits are inactivated by an initialization signal input externally.

9. A shift register according to claim 8, wherein each of the latch circuits includes one synchronous NAND circuit or synchronous NOR circuit, and the initialization signal is input into the synchronous NAND circuit or synchronous NOR circuit.

10. A shift register according to claim 1, wherein each of the clock signal control circuits includes a logic circuit which supplies the clock signal to the latch circuits in the corresponding circuit block in response to the input of an external initialization signal irrespective of the output signals from the latch circuits in the circuit blocks preceding and subsequent to the corresponding circuit block as the control signal.

11. An active matrix image display apparatus using a shift register according to claim 8, comprising:

a liquid crystal panel including a plurality of pixels arranged in columns and rows, a plurality of data signal lines disposed for the columns of the pixels, and a plurality of scanning signal lines disposed for the rows of the pixels, image data for image display being supplied from the data signal lines to the pixels in synchronization with a scanning signal supplied from the scanning signal lines;

a data signal line driver for sequentially outputting the image data to the plurality of data signal lines in synchronization with a prescribed timing signal; and a scanning signal line driver for sequentially outputting the scanning signal to the plurality of scanning signal lines in synchronization with a prescribed timing signal, wherein the data signal line driver includes the shift register as a circuit for sequentially shifting a sampling signal for receiving the image data in correspondence with the data signal lines, and the initialization signal is input into the shift register when the image display apparatus is turned on.

12. An active matrix image display apparatus using a shift register according to claim 8, comprising:

a liquid crystal panel including a plurality of pixels arranged in columns and rows, a plurality of data signal lines disposed for the columns of the pixels, and a plurality of scanning signal lines disposed for the rows of the pixels, image data for image display being supplied from the data signal lines to the pixels in synchronization with a scanning signal supplied from the scanning signal lines;

a data signal line driver for sequentially outputting the image data to the plurality of data signal lines in synchronization with a prescribed timing signal; and a scanning signal line driver for sequentially outputting the scanning signal to the plurality of scanning signal lines in synchronization with a prescribed timing signal, wherein the scanning signal line driver includes the shift register as a circuit for sequentially shifting the scanning signal in correspondence with the scanning signal lines, and the initialization signal is input into the shift register when the image display apparatus is turned on.

13. An active matrix image display apparatus using a shift register according to claim 8, comprising:

a liquid crystal panel including a plurality of pixels arranged in columns and rows, a plurality of data signal lines disposed for the columns of the pixels, and a plurality of scanning signal lines disposed for the rows of the pixels, image data for image display being supplied from the data signal lines to the pixels in synchronization with a scanning signal supplied from the scanning signal lines;

a data signal line driver for sequentially outputting the image data to the plurality of data signal lines in synchronization with a prescribed timing signal; and a scanning signal line driver for sequentially outputting the scanning signal to the plurality of scanning signal lines in synchronization with a prescribed timing signal, wherein the data signal line driver includes the shift register as a circuit for sequentially shifting a sampling signal for receiving the image data in correspondence with the data signal lines, and the initialization signal is input into the shift register every vertical scanning retrace interval.

14. An active matrix image display apparatus using a shift register according to claim 8, comprising:

a liquid crystal panel including a plurality of pixels arranged in columns and rows, a plurality of data signal lines disposed for the columns of the pixels, and a plurality of scanning signal lines disposed for the rows of the pixels, image data for image display being supplied from the data signal lines to the pixels in synchronization with a scanning signal supplied from the scanning signal lines;

a data signal line driver for sequentially outputting the image data to the plurality of data signal lines in synchronization with a prescribed timing signal; and a scanning signal line driver for sequentially outputting the scanning signal to the plurality of scanning signal lines in synchronization with a prescribed timing signal, wherein the scanning signal line driver includes the shift register as a circuit for sequentially shifting the scanning signal in correspondence with the scanning signal lines, and the initialization signal is input into the shift register every vertical scanning retrace interval.

15. An active matrix image display apparatus according to claim 13, wherein a scanning start signal for the scanning signal line driver is used as the initialization signal.

16. An active matrix image display apparatus according to claim 14, wherein a scanning start signal for the scanning signal line driver is used as the initialization signal.

17. A shift register for sequentially transferring a digital signal in synchronization with a clock signal, comprising:

a plurality of sequentially connected latch circuits organized into first through nth circuit blocks; and first through nth clock signal control circuits each of which is supplied with the clock signal and which selectively outputs to the latch circuits of a respective corresponding one of said first through nth circuit blocks an internal clock signal for transferring the digital signal, wherein each of the second through (n-1)th clock signal control circuits is connected to an output of a latch circuit contained in a preceding circuit block and to an output of a latch circuit contained in a following circuit block.

18. A shift register according to claim 17, wherein each of the second through (n-1)th clock signal control circuits is connected to an output of the last latch circuit in the immediately preceding circuit block and to an output of the second latch circuit in the immediately following circuit block.

19. A shift register according to claim 17, wherein each of the second through (n-1)th clock signal control circuits begins output of the internal clock signal in response to the output of the latch circuit contained in the preceding circuit block and terminates output of the internal clock signal in response to the output of the latch circuit contained in the following circuit block.

20. A shift register according to claim 17, wherein at least some of said circuit blocks contain different numbers of latch circuits.

21. A shift register according to claim 17, wherein said first clock signal control circuit is connected to a terminal supplied with a start signal and to an output of a latch circuit contained in a following circuit block.

22. A shift register according to claim 21, wherein said first clock signal control circuit begins output of the internal clock signal in response to the start signal and terminates output of the internal clock signal in response to the output of the latch circuit contained in the following circuit block.

23. A shift register according to claim 21, wherein said first clock signal control circuit is connected to the output of a second latch circuit contained in the immediately following circuit block.

24. A shift register according to claim 17, wherein outputs of said latch circuits are deactivated in response to an external initialization signal input to said shift register.

25. A shift register according to claim 24, wherein each latch circuit comprises either a synchronous NOR circuit or a synchronous NAND circuit, and the initialization signal is input to the synchronous NOR or the synchronous NAND circuit.

26. An active matrix image display apparatus, comprising:

a liquid crystal panel comprising a plurality of data signal lines, a plurality of scanning signal lines, and a plurality of pixels arranged at intersections of said data signal lines and said scanning signal lines, image data being supplied from said data lines to said pixels in synchronization with a scanning signal supplied from said scanning signal lines;

a data signal line driver configured to sequentially output the image data to said plurality of data signal lines in synchronization with a first timing signal;

a scanning signal line driver configured to sequentially output the scanning signal to said plurality of scanning signal lines in synchronization with a second timing signal, wherein either one, or both, of said data signal line driver and said scanning signal driver comprises a shift register according to claim 24, and wherein the initialization signal is input to said shift register in synchronization with a vertical scanning retrace interval.

27. An active matrix image display apparatus, comprising:

a liquid crystal panel comprising a plurality of data signal lines, a plurality of scanning signal lines, and a plurality of pixels arranged at intersections of said data signal lines and said scanning signal lines, image data being supplied from said data lines to said pixels in synchronization with a scanning signal supplied from said scanning signal lines;

a data signal line driver configured to sequentially output the image data to said plurality of data signal lines in synchronization with a first timing signal;

a scanning signal line driver configured to sequentially output the scanning signal to said plurality of scanning signal lines in synchronization with a second timing signal, wherein either one, or both, of said data signal line driver and said scanning signal driver comprises a shift register according to claim 24, and wherein the initialization signal is input to said shift register when said image display apparatus is switched on.

28. An active matrix image display apparatus, comprising:

a liquid crystal panel comprising a plurality of data signal lines, a plurality of scanning signal lines, and a plurality of pixels arranged at intersections of said data signal lines and said scanning signal lines, image data being supplied from said data lines to said pixels in synchronization with a scanning signal supplied from said scanning signal lines;

a data signal line driver configured to sequentially output the image data to said plurality of data signal lines in synchronization with a first timing signal;

a scanning signal line driver configured to sequentially output the scanning signal to said plurality of scanning signal lines in synchronization with a second timing signal, wherein either one, or both, of said data signal line driver and said scanning signal driver comprises a shift register according to claim 17.

29. A shift register according to claim 17, wherein all of said clock signal control circuits output internal clock signals in response to an external initialization signal input to said shift register.

30. A shift register according to claim 17, further comprising:

an additional circuit block comprising a plurality of latch circuits and which is connected to an output of the nth circuit block; and an additional clock signal control circuit supplied with the clock signal and selectively outputting an internal clock signal to the latch circuits of the additional circuit block, said additional clock signal control circuit connected to a terminal supplied with a start signal and to an output of a latch circuit contained in the nth circuit block, wherein the nth clock signal control circuit is connected to an output of a latch circuit contained in a preceding circuit block and to an output of a latch circuit contained in said additional circuit block.

31. A shift register according to claim 17, wherein said first clock signal control circuit is connected to a terminal supplied with a start signal and to an output of a latch circuit contained in the second circuit block, and said nth clock signal control circuit is connected to the terminal supplied with the start signal and to an output of a latch circuit in the (n-1) th circuit block.

* * * * *